US009255357B2

(12) United States Patent
Bae et al.

(10) Patent No.: US 9,255,357 B2
(45) Date of Patent: Feb. 9, 2016

(54) LAUNDRY TREATMENT APPARATUS

(71) Applicant: LG ELECTRONICS INC., Seoul (KR)

(72) Inventors: Sanghun Bae, Seoul (KR); Jeongyun Kim, Seoul (KR); Hongjun Cho, Seoul (KR); Hyunwoo Noh, Seoul (KR); Yongcheol Jin, Seoul (KR); Seungphyo Ahn, Seoul (KR); Donghyun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/318,284

(22) Filed: Jun. 27, 2014

(65) Prior Publication Data

US 2014/0339970 A1 Nov. 20, 2014

Related U.S. Application Data

(62) Division of application No. 13/404,187, filed on Feb. 24, 2012, now abandoned.

(30) Foreign Application Priority Data

| | | |
|---|---|---|
| Feb. 24, 2011 | (KR) | 10-2011-0016437 |
| Jul. 19, 2011 | (KR) | 10-2011-0071423 |
| Jul. 19, 2011 | (KR) | 10-2011-0071424 |
| Dec. 21, 2011 | (KR) | 10-2011-0139294 |
| Dec. 21, 2011 | (KR) | 10-2011-0139447 |
| Jan. 6, 2012 | (KR) | 10-2012-0001880 |
| Jan. 6, 2012 | (KR) | 10-2012-0001881 |

(51) Int. Cl.
*D06F 39/14* (2006.01)
*D06F 37/28* (2006.01)

(52) U.S. Cl.
CPC ..... *D06F 39/14* (2013.01); *D06F 37/28* (2013.01)

(58) Field of Classification Search
CPC ... D06F 39/14; D06F 37/28; Y10T 292/1022; Y10T 292/1028; Y10T 292/1023; Y10T 292/1024; Y10T 292/42; Y10T 292/444; Y10T 292/426; Y10T 292/432; Y10T 292/438
USPC ..... 312/292, 291, 295, 298, 228, 236, 226, 312/227, 326–329; 34/601–610; 68/3 R, 24, 68/139, 196; 126/190, 194, 273 R; 134/56 D, 57 D, 57 DL, 58; 292/137, 292/138, 145, 163, 175, DIG. 11, DIG. 69, 292/DIG. 17
See application file for complete search history.

(56) References Cited

U.S. PATENT DOCUMENTS

| | | | | |
|---|---|---|---|---|
| 1,545,737 A * | 7/1925 | Chruden | ..... | 292/138 |
| 2,815,018 A | 12/1957 | Collins | ..... | 126/190 |

(Continued)

FOREIGN PATENT DOCUMENTS

| | | |
|---|---|---|
| CN | 1504601 A | 6/2004 |
| DE | 3922839 A1 | 1/1991 |

(Continued)

OTHER PUBLICATIONS

Russian Decision on Grant dated Feb. 2, 2015 issued in Application No. 2013143156 (with English translation).

(Continued)

*Primary Examiner* — Andrew Roersma
(74) *Attorney, Agent, or Firm* — Ked & Associates, LLP

(57) ABSTRACT

A laundry treatment apparatus may facilitate input and removal of laundry items. The laundry treatment apparatus may include a door which may selectively open and close an opening into a receiving space formed in a cabinet in which laundry items may be received for treatment. The door may serve as a laundry guide when positioned at an angle relative to the cabinet so as to guide laundry items into the receiving space, and may serve as a shelf to support laundry items thereon when positioned at another angle relative to the cabinet.

15 Claims, 24 Drawing Sheets

(56) References Cited

U.S. PATENT DOCUMENTS

| | | | | | |
|---|---|---|---|---|---|
| 3,018,508 | A | | 1/1962 | Keeling | 16/147 |
| 3,321,100 | A | * | 5/1967 | Toma | 220/835 |
| 3,521,319 | A | | 7/1970 | Fisher | |
| 4,096,602 | A | | 6/1978 | Nelson | 16/85 |
| 4,222,149 | A | * | 9/1980 | Holbek | 16/232 |
| 4,302,907 | A | * | 12/1981 | Canals et al. | 49/65 |
| 4,430,809 | A | | 2/1984 | Jackson et al. | 34/133 |
| 5,052,151 | A | * | 10/1991 | Inui | 49/394 |
| 5,253,433 | A | | 10/1993 | Frey | 34/133 H |
| 5,341,542 | A | | 8/1994 | Hannan et al. | 16/289 |
| 5,437,168 | A | | 8/1995 | Mason et al. | 68/3 R |
| 5,447,145 | A | * | 9/1995 | Cappello et al. | 126/20 |
| 5,463,821 | A | | 11/1995 | Gauer | 34/261 |
| 5,496,104 | A | | 3/1996 | Arnold et al. | 312/204 |
| 6,622,531 | B2 | | 9/2003 | Ren et al. | 68/140 |
| 6,686,574 | B2 | | 2/2004 | Hyun | 219/739 |
| 6,938,444 | B2 | | 9/2005 | Hong et al. | 68/196 |
| 7,551,873 | B2 | * | 6/2009 | Hiura | 399/107 |
| 7,581,414 | B2 | | 9/2009 | Kim et al. | 68/196 |
| 2004/0168484 | A1 | | 9/2004 | Kim et al. | 68/24 |
| 2006/0059710 | A1 | | 3/2006 | Kim | 34/603 |
| 2006/0222435 | A1 | * | 10/2006 | Ha et al. | 400/691 |
| 2008/0245112 | A1 | | 10/2008 | Sung | 68/12.26 |
| 2009/0229316 | A1 | | 9/2009 | Yoo et al. | 68/13 R |
| 2010/0212112 | A1 | | 8/2010 | Steurer et al. | 16/286 |
| 2011/0120195 | A1 | | 5/2011 | Jeoung et al. | 68/139 |

FOREIGN PATENT DOCUMENTS

| | | | |
|---|---|---|---|
| EP | 1 389 643 | A2 | 2/2004 |
| EP | 1 424 429 | | 6/2004 |
| EP | 1 978 145 | A2 | 10/2008 |
| GB | 979170 | | 1/1965 |
| GB | 2 115 473 | A | 9/1983 |
| GB | 2360297 | | 9/2001 |
| JP | 2005-354852 | A | 12/2005 |
| KR | 10-2005-0123195 | A | 12/2005 |
| KR | 10-2007-0038720 | A | 4/2007 |
| KR | 1 020090096948 | A | 9/2009 |
| KR | 10-2010-0070707 | A | 6/2010 |
| KR | 1020110057920 | A | 6/2011 |
| RU | 2006 106 917 | A | 9/2007 |
| WO | WO 2006072904 | A1 | 7/2006 |
| WO | WO 2011/063486 | A1 | 6/2011 |

OTHER PUBLICATIONS

International Search Report issued in PCT Appln. No. PCT/KR2012/001393 dated Jun. 11, 2013.

International Search Report issued in Application No. PCT/KR2012/001393 dated Aug. 5, 2013.

Chinese Office Action dated Jun. 2, 2015 issued in Application No. 201280005004.8 (with English Translation).

* cited by examiner

LAUNDRY TREATMENT APPARATUS

CROSS-REFERENCE TO RELATED APPLICATION(S)

This application is a Divisional Application of prior U.S. patent application Ser. No. 13/404,187 filed Feb. 24, 2012, which claims priority under 35 U.S.C. §119 to Korean Patent Application Nos. 10-2011-0016437 filed in Korea on Feb. 24, 2011, 10-2011-0071424 filed in Korea on Jul. 19, 2011, 10-2011-0071423 filed in Korea on Jul. 19, 2011, 10-2011-0139447 filed in Korea on Dec. 21, 2011, 10-2011-0139294 filed in Korea on Dec. 21, 2011, 10-2012-0001880 filed in Korea on Jan. 6, 2012 and 10-2012-0001881 filed in Korea on Jan. 6, 2012, whose entire disclosures are hereby incorporated by reference.

BACKGROUND

1. Field

This relates to a laundry treatment apparatus that provides for washing and/or drying of one or more laundry items.

2. Background

A laundry treatment apparatus may be, for example, a washer to wash laundry, a dryer to dry laundry, or a combined washer/dryer to both wash and dry laundry. A cabinet may define an exterior of the laundry treatment apparatus, and a storage space may be formed in the cabinet to receive laundry to be treated. An input opening may be formed in the cabinet to provide access to an interior of the storage space, and a door may open or close the input opening.

In a top loading type laundry treatment apparatus, the storage space may be oriented in a direction perpendicular to the bottom of the cabinet and the door may be located at the top of the cabinet. In a front loading type laundry treatment apparatus, the storage space may be oriented in a direction parallel to the bottom of the cabinet and the door may be located at the front of the cabinet. In such a front loading type laundry treatment apparatus it may be difficult to adjust a rotating angle of the door and/or an opening degree of the input opening. Further, the position of the door may require that the user bend at the waist when loading laundry into or removing laundry from the storage space.

BRIEF DESCRIPTION OF THE DRAWINGS

The embodiments will be described in detail with reference to the following drawings in which like reference numerals refer to like elements wherein.

DETAILED DESCRIPTION

A laundry treatment apparatus 100 as embodied and broadly described herein may include a cabinet 1 defining an external appearance of the laundry treatment apparatus 100, the cabinet 1 having an input opening 11, a storage space S formed in the cabinet 1 to receive store laundry (an object to be washed and/or dried), and a door 3 to selectively open and close the input opening 11.

Figure 1:
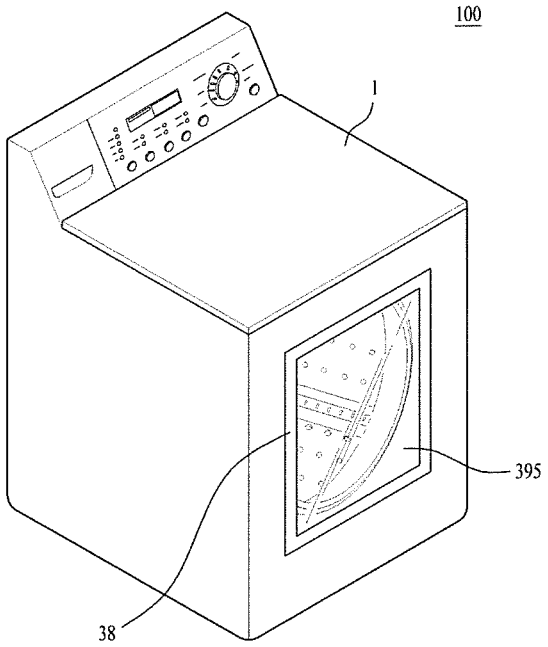
FIGS. 1 to 3 are perspective views of a laundry treatment apparatus with a door having an adjustable rotating angle, in accordance with embodiments as broadly described herein.
Figure 2:
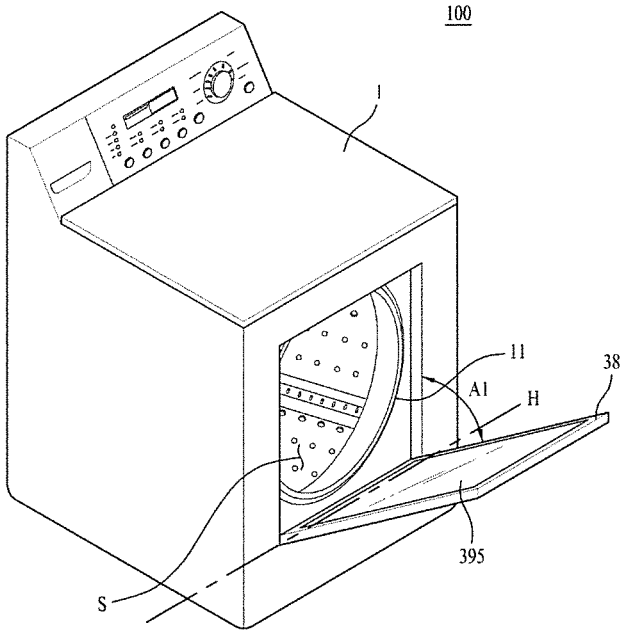
Figure 3:
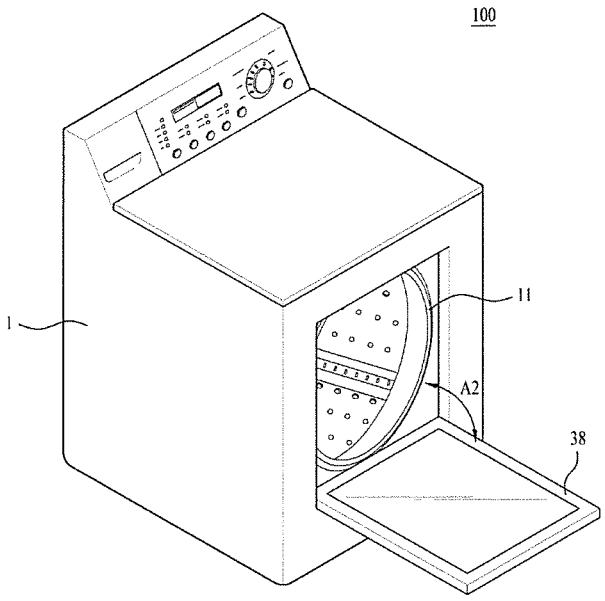

As shown in, for example, FIGS. 1-3, the input opening 11 may be provided at the front of the cabinet 1. In alternative embodiments, the input opening 11 may be provided at the top of the cabinet 1. For convenience of description, the following description is based on the assumption that the input opening 11 is provided at the front of the cabinet 1.

In an embodiment in which the laundry treatment apparatus 100 is used only for the purpose of drying, the storage space S may include only a drum rotatably installed in the cabinet 1. However, in an embodiment in which the laundry treatment apparatus 100 also performs a washing function, the storage space S may include a tub installed in the cabinet 1 to store wash water and a drum rotatably installed in the tub.

The laundry treatment apparatus 100 may also include a processor that controls performance of certain processes (e.g., washing and drying) on laundry received in the storage space S, using, for example, a drive system that rotates the drum, a water supply system that supplies water to the tub, and a drain system that discharges water from the tub to an outside of the tub. The processor may also control a hot air supply system that supplies heated air to laundry received in the storage space S so as to dry the laundry, and a steam supply system that removes odor or wrinkles from laundry by supplying steam to the laundry, or that may heat water in the storage space S by supplying steam to the storage space S.

In certain arrangements, the door may rotate leftward or rightward about a vertically oriented rotating shaft installed perpendicular to the bottom of the cabinet 1 to selectively open and close the input opening 11, requiring a user to bend at the waist when putting laundry into and removing laundry from the storage space S. In the embodiment shown in FIGS. 1-3, the door may rotate about a horizontally oriented rotating shaft H installed parallel to the bottom of the cabinet 1, and a rotating angle of the door relative to the cabinet 1 is adjustable. In certain embodiments, the door may be rotatable about the rotating shaft H ins by at least two different rotating angles, thereby adjusting an opening degree of the input opening 11.

In the laundry treatment apparatus 100 as embodied and broadly described herein, various numbers of doors may be provided, each including the above described function. For example, the laundry treatment apparatus 100 may include only a single door as illustrated in FIGS. 1 to 3, or may include two or more doors as illustrated in FIGS. 4 to 10.

The door, e.g., the first door 38 in certain embodiments as broadly described herein, may include a transparent plate 395 so that an interior of the storage space S is visible from the outside of the laundry treatment apparatus 100. The door 38 may have at least two rotating angles. FIG. 2 illustrates the case in which the door 38 is rotated from the input opening 11 by a first angle A1, which may be an angle at which the door 38 may guide laundry to the input opening 11, and FIG. 3 illustrates the case in which the door 38 is rotated from the input opening 11 by a second angle A2, which may be an angle at which the door 38 may support laundry thereon.

The laundry treatment apparatus 100 may also include a device to maintain a desired position of the door 38 which has been rotated from the input opening 11 by the first angle A1 or the second angle A2. Examples of such a device may include, for example, a fixing mechanism provided at the door 38 and a receiving mechanism provided at the cabinet 1 for coupling of the fixing mechanism.

The fixing mechanism may be connected to the door 38 by, for example, a bar, a wire a spring (elastic member), or other means as appropriate, and the cabinet 1 may be provided with at least two receiving mechanisms to receive the fixing mechanism. As the fixing mechanism is coupled with the receiving mechanisms, a rotating angle of the door 38 may be adjusted and maintained.

The device to maintain a position of the door 38 at the first angle A1 or the second angle A2 may include a first door hinge.

As illustrated in FIG. 2, in the case in which the door 38 is rotated from the input opening 11 about the rotating shaft H to the first angle A1, the user may put laundry into the storage space S without bending at the waist, using the door 38 and the angle at which the door 38 is oriented as a guide that guides the laundry toward the input opening 11. Specifically, if the user directs laundry into a space formed between the input opening 11 and the door 38 positioned at the first angle A1, the laundry is moved toward the input opening 11 along the door 38, thereby being supplied into the storage space S without requiring the user to bend at the waist.

The first angle A1 may be set to various values as appropriate for a particular laundry treatment apparatus and installation environment. For example, if a rotating angle of the door 38 relative to the cabinet 1 when the door 38 is positioned against the cabinet 1 to close the input opening 11 is defined as zero degrees, the first angle A1 may be set to a range of approximately 30 to 60 degrees. If the rotating angle of the door 38 is less than 30 degrees, the space between the door 38 and the input opening 11 is relatively narrow, causing difficulty in supplying laundry into the storage space S. On the other hand, if the rotating angle of the door 38 is greater than 60 degrees, the laundry directed into the space between the door 38 and the input opening 11 may have difficulty in moving toward the input opening 11. In certain embodiments, the first angle A1 may be set to a range of 20 to 50 degrees, or other angles as necessary for a particular application.

As illustrated in FIG. 3, in the case in which a position of the door 38 is maintained at the second angle A2, the user may utilize the door 38 as a shelf when removing laundry from the storage space S. In this case, the second angle A2 may be greater than the first angle A1, and therefore allows the user to put the laundry removed from the storage space S on the door 38

The second angle A2 may be set to various values as appropriate for a particular type of laundry treatment apparatus and installation environment. For example, the second angle A2 may be set to a range of 60 to 90 degrees. If the second angle A2 is less than 60 degrees, laundry may move back toward the input opening 11. If the second angle A2 is greater than 90 degrees, the door 38 may be unable to support laundry, and the laundry may fall to the floor.

Figure 4:
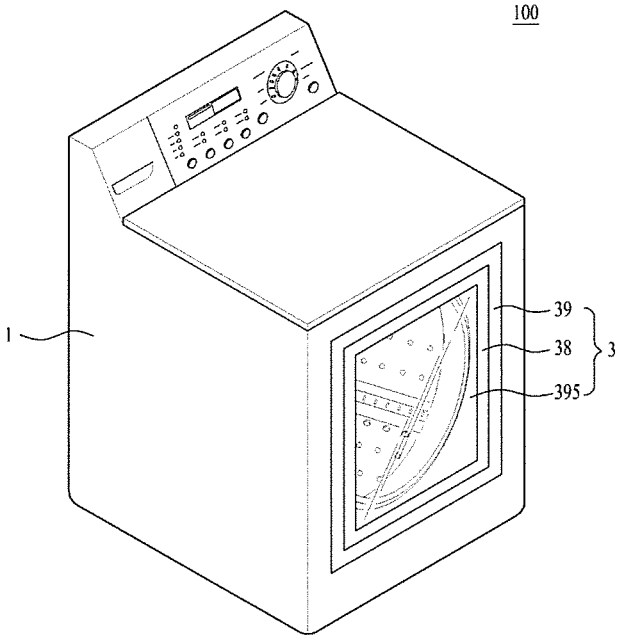
FIGS. 4 to 6 are perspective views of a laundry treatment apparatus having two doors which have the same rotating direction, but have different maximum rotating angles, in accordance with embodiments as broadly described herein.
Figure 5:
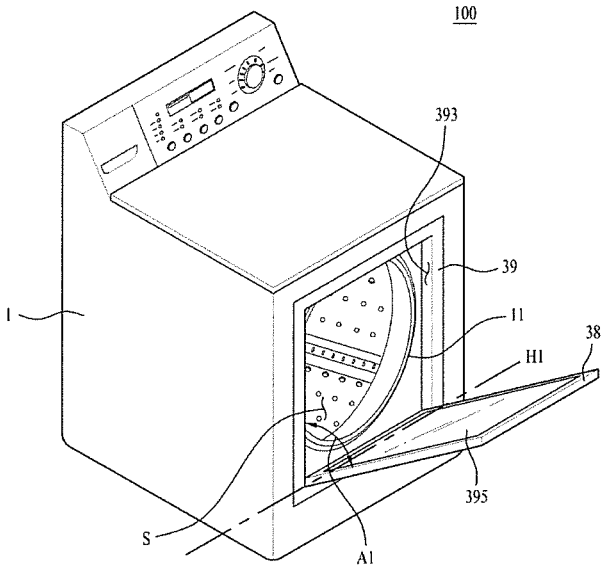
Figure 6:
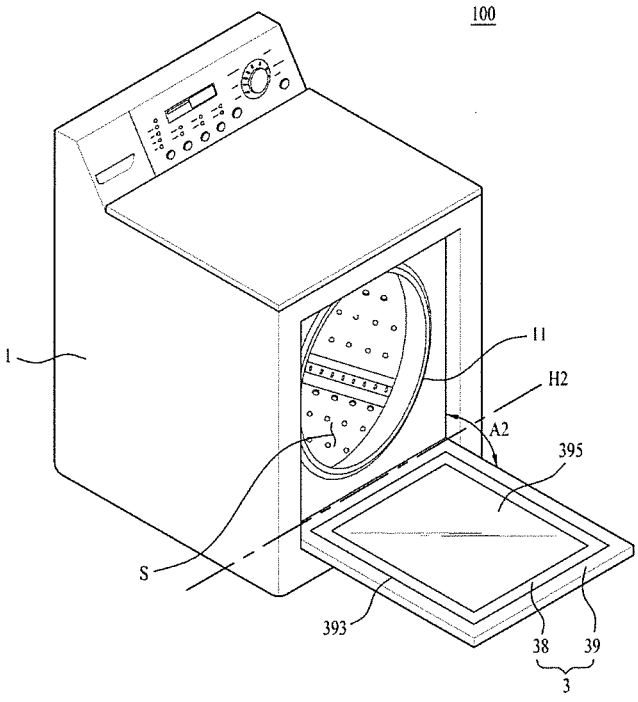
Figure 7:
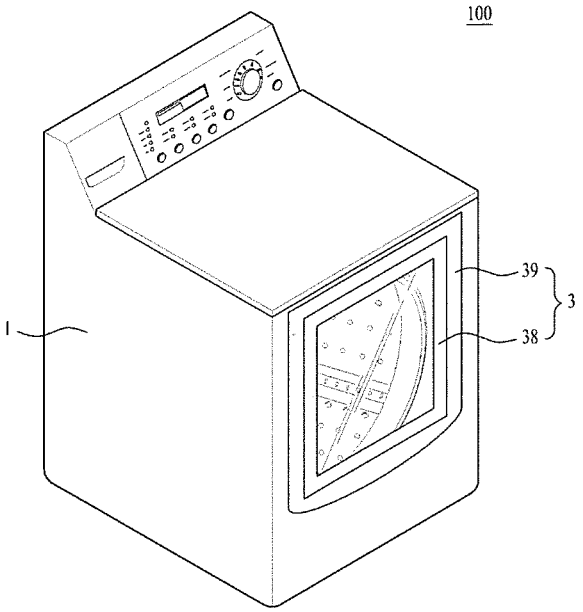
FIGS. 7 to 9 are perspective views of a laundry treatment apparatus having two doors which have different rotating directions, in accordance with embodiments as broadly described herein.
Figure 8:
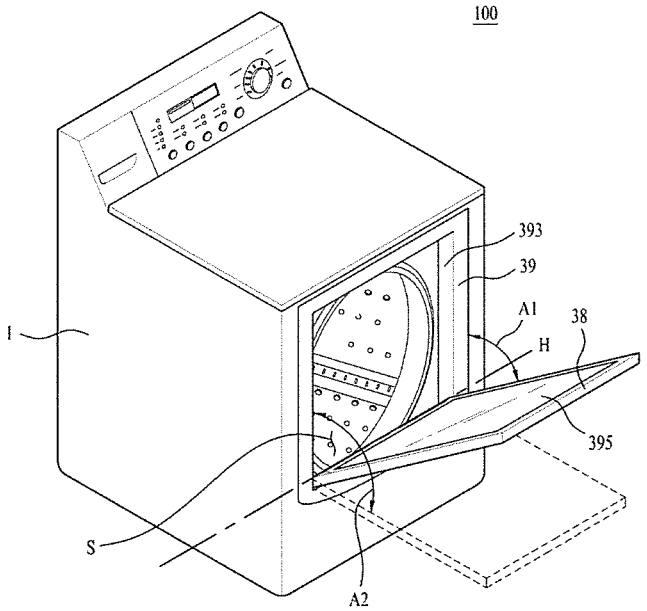
Figure 9:
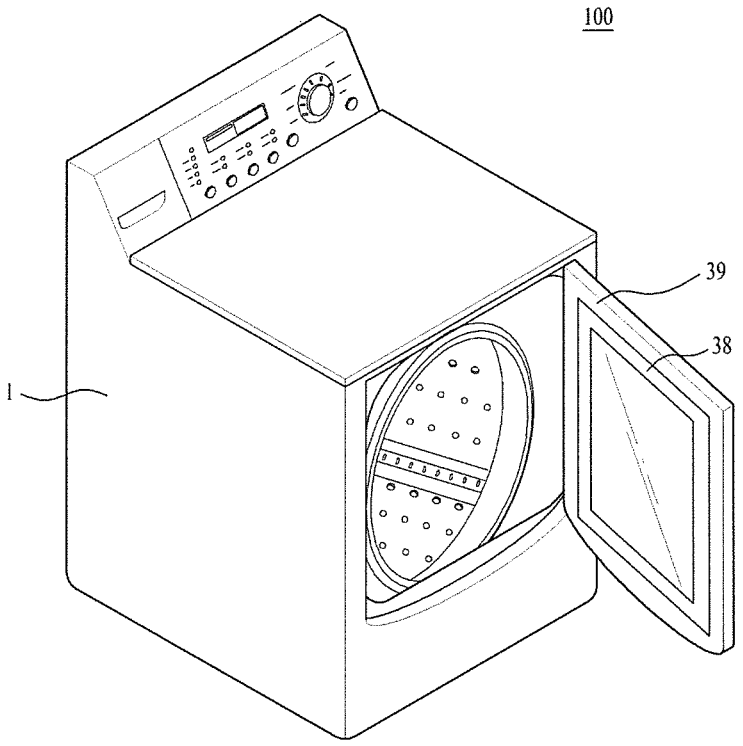

In alternative embodiments, a laundry treatment apparatus 100 as embodied and broadly described herein may include two or more doors. In this case, the respective doors may have a difference in terms of at least one of a rotating direction and/or a maximum rotating angle. FIGS. 4 to 6 illustrate a laundry treatment apparatus having two doors which have the same rotating direction, but have different maximum rotating angles, and FIGS. 7 to 9 illustrate a laundry treatment apparatus having two doors which have different rotating directions.

The laundry treatment apparatus 100 shown in FIGS. 4-6 may include a second door 39 rotatably secured to the cabinet 1 and a first door 38 rotatably secured to the second door 39. The second door 39 may be rotated about a horizontally oriented rotating shaft H2, as shown in FIG. 6, installed parallel to the bottom of the cabinet 1, and may include a second door through-hole 393, as shown in FIG. 5, communicating with the input opening 11. The first door 38 may be rotatably secured to the second door 39 so as to selectively open and close the second door through-hole 393. The first door 38 may be rotated about a horizontally oriented rotating shaft H1, as shown in FIG. 5, installed parallel to the rotating shaft H2 of the second door 39, and may include a transparent plate 395 so that the interior of the storage space S is visible from the outside of the laundry treatment apparatus 100. Orienting the rotating shaft H1 of the first door 38 and the rotating shaft H2 of the second door 39 parallel to each other allows the second door 39 and the first door 38 have the same rotating direction.

When the first door 38 is rotated, the second door through-hole 393 is opened and therefore, the input opening 11 is exposed. Since the first door 38 is fixed to the second door 39, the input opening 11 is exposed outward even when the second door 39 is rotated. As such, the user may open the input opening 11 by rotating either one of the first door 38 or the second door 39.

The second door 39 may have a maximum rotating angle corresponding to an angle required to support laundry when the laundry is removed from the storage space S (i.e. the second angle A2), and the first door 38 may have a maximum rotating angle corresponding to an angle required to guide movement of laundry to the input opening 11 when the laundry is supplied into the storage space S (i.e. the first angle A1).

That is, the maximum rotating angle of the second door 39 may be set to a range of 60 to 90 degrees and the maximum rotating angle of the first door 38 may be set to a range of 30 to 60 degrees (or, in certain embodiments, to a range of 20 to 50 degrees).

It is noted that the above described maximum rotating angles of the first door 38 and the second door 39 are given by way of example and thus, may be set differently from the above described ranges as appropriate for a particular application.

Although FIGS. 4 to 6 illustrate the case in which the second door 39 is rotatably secured to the cabinet 1 and the first door 38, which has a rotating angle less than a rotating angle of the second door 39, is rotatably secured to the second door 39, it may also be possible that the first door 38 is rotatably secured to the cabinet 1 and the second door 39 is rotatably secured to the first door 38. However, in this case, the size of the second door 39 may be less than the size of the first door 38, and thus a space available to support laundry thereon may be disadvantageously reduced.

The laundry treatment apparatus 100 may include a device (e.g., a first door hinge) that facilitates the rotation of the first door 38 and that maintains a position of the first door 38.

FIGS. 7 to 9 illustrate another embodiment in which the laundry treatment apparatus 100 includes at least two doors having different rotating directions.

As shown in FIGS. 7-9, the door 3 may include the first door 38 having a horizontally oriented rotating shaft H installed parallel to the bottom of the cabinet 1 and the second door 39 having a vertically oriented rotating shaft V installed perpendicular to the bottom of the cabinet 1. In this case, the second door 39 may be rotatably secured to the cabinet 1 and the first door 38 may be rotatably secured to the second door 39. Accordingly, when the first door 38 is rotated, the second door through-hole 393 is open and therefore, the input opening 11 is exposed outward. Since the first door 38 is fixed to the second door 39, the input opening 11 is exposed outward even when the second door 39 is rotated. As such, the user may open the input opening 11 by rotating either one of the first door 38 and/or the second door 39, so as to enable input and removal of laundry.

The first door 38 may be rotatable by an angle required to guide laundry to the input opening 11 and an angle required to support laundry thereon when the laundry is removed from the storage space S, and the second door 39 may be rotatable by an angle required to facilitate removal of laundry from the storage space S.

For example, a position of the first door 38 may maintained at the first angle A1 (30 to 60 degrees, or, in certain embodiments, 20 to 50 degrees) and the second angle A2 (60 to 90 degrees), and the second door 39 may be rotated by an angle greater than the second angle A2.

It is noted that the rotating angle of the first door 38 and the rotating angle of the second door 39 are given by way of example and thus, the rotating angles of the respective doors may be set differently from the above described ranges.

The laundry treatment apparatus 100 may also include a device (e.g., a first door hinge) to facilitate rotation of the first door 38 and maintenance of the first door 38 at a constant rotating angle/position (i.e., the first angle or the second angle) from the input opening 11.

Figure 10A:
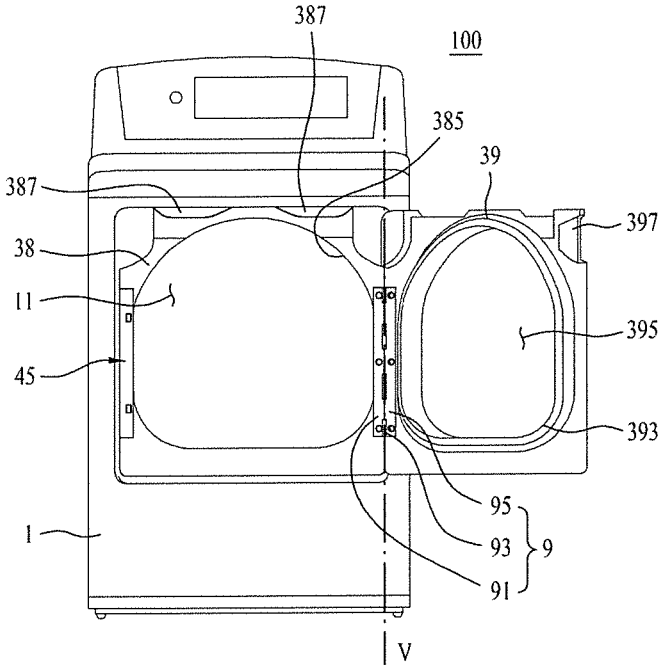
FIGS. 10A and 10B illustrate another embodiment of a laundry treatment apparatus having two doors which have different rotating directions.
Figure 10B:
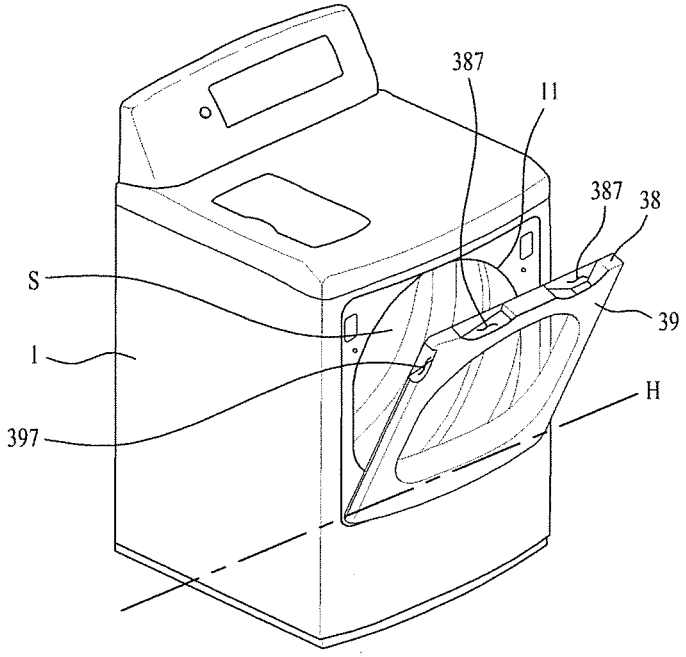

As illustrated in FIG. 10, the door 3 may include the first door 38 rotatably secured to the cabinet 1 and the second door 39 rotatably secured to the first door 38. In this case, the first door 38 may be rotated about the horizontal rotating shaft H, and the second door 39 may be rotated about the vertical rotating shaft V A door handle may be provided to assist in easily opening or closing each of the doors described above. In the case in which two doors are provided, the first door 38 may include a first door handle 387 and the second door 39 may include a second door handle 397. The first door handle 387 and the second door handle 397 may be provided at different positions.

For example, the first door handle 387 may be provided in a direction parallel to the bottom of the cabinet 1 or a direction perpendicular to the bottom of the cabinet 1. The second door handle 397 may be provided in the other of the direction parallel to the bottom of the cabinet 1 or the direction perpendicular to the bottom of the cabinet 1. Positioning the first and second door handles 387 and 397 in this manner allows the user to easily discern the door to be opened.

In the exemplary embodiment shown in FIG. 10 first door handle 387 provided at the first door 38 is positioned so as to be parallel to the bottom of the cabinet 1 and the second door handle 397 provided at the second door 39 is positioned so as to be perpendicular to the bottom of the cabinet 1. This provides for convenient rotation of each door as the first door handle 387 and the second door handle 397 are parallel to the rotating shafts of the respective doors 38 and 39.

The numbers of first and second door handles 387 and e 397 provided may vary. Although FIG. 10 illustrates two first door handles 387 and two second door handles 397, the first door 38 may be provided with a single first door handle 387 and the second door 39 may be provided with a single second door handle 397. Other arrangements may also be appropriate. However, it is noted that respectively providing two second door handles 397 at two opposite lateral sides of the second door 39 may eliminate a need to change the configuration of the second door 39 if a rotating direction of the second door 39 is changed.

The rotating direction of the second door 39 may be set according to a user selection. For example, although FIG. 10 illustrates a configuration in which the second door 39 is rotated rightward of the first door 38 to open the input opening 11, the second door 39 may be rotated leftward of the first door 38 to open the input opening 11 as necessary. Accordingly, respectively providing the two second door handles 397 at two opposite lateral sides of the second door 39 may allow the second door handles 397 to assist in rotating the second door 39 regardless of a selected rotation direction of the second door 39.

Hereinafter, a device to adjust rotation and the rotating angle of the first door 38 and a device to enable rotation of the second door 39 will be described.

The laundry treatment apparatus 100 illustrated in FIGS. 1 to 3 employs a first door hinge 8 to adjust rotation and the rotating angle of the first door 38, whereas the laundry treatment apparatus 100 illustrated in FIGS. 4 to 10 employs a second door hinge 9 to rotate the second door 39 in addition to the first door hinge 8 to adjust rotation and the rotating angle of the first door 38.

in the laundry treatment apparatus 100 of FIG. 1 the first door hinge 8 is provided between the first door 38 and the cabinet 1. In the laundry treatment apparatus 100 of FIGS. 4 and 7 the first door hinge 8 is provided between the first door 38 and the second door 39, and—the second door hinge 9 is provided between the second door 39 and the cabinet 1. Also, in the laundry treatment apparatus 100 of FIG. 10 the first door hinge 8 is provided between the first door 38 and the cabinet 1 and the second door hinge 9 is provided between the second door 39 and the first door 38.

Hereinafter, for convenience of description, configurations of the first door hinge 8 and the second door hinge 9 will be described based on the laundry treatment apparatus 100 shown in FIG. 10.

Figure 11:
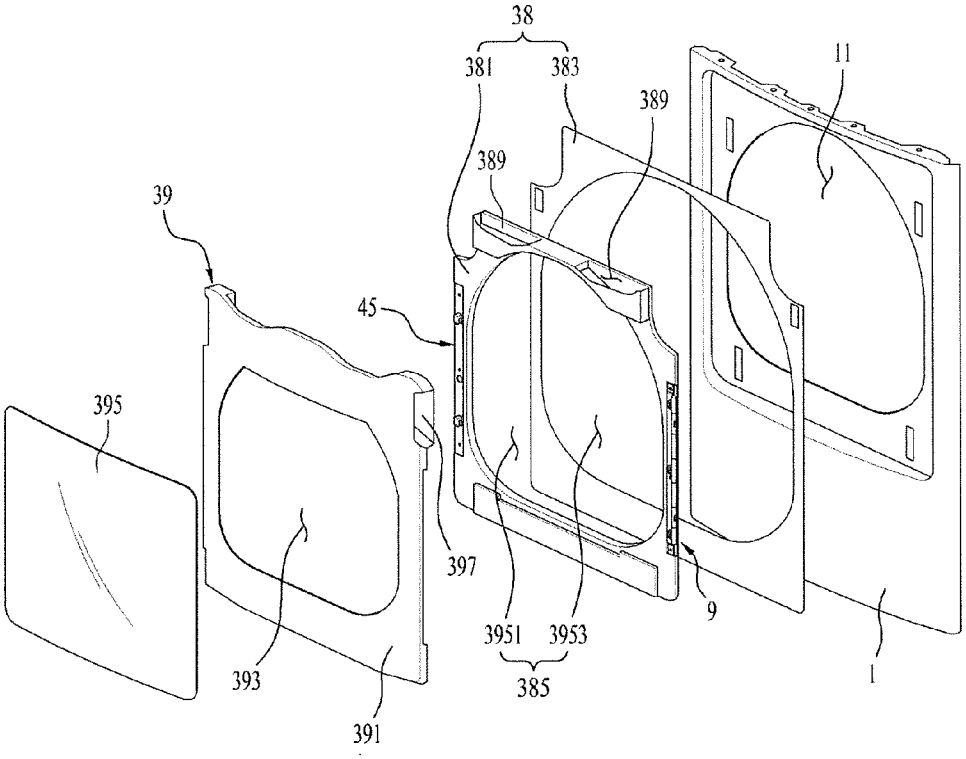
FIGS. 11 and 12 provide an exploded perspective view and a perspective view, respectively, of a door of the laundry treatment apparatus shown in FIG. 10.

As illustrated in FIG. 11, the door 3 in accordance with an embodiment as broadly described herein includes the first door 38, which has a first door through-hole 385 corresponding to the input opening 11 and is rotatably secured to the cabinet 1, and the second door 39, which is rotatably secured to the first door 38 so as to open or close the first door through-hole 385.

The first door 38 may include a first door frame 381 defining an external appearance of the first door 38 and a first door cover 383 secured to the first door frame 381. In this case, the first door through-hole 385 may include a frame through-hole 3851 perforated in the first door frame 381 and a cover through-hole 3853 perforated in the first door cover 383.

Additionally, the first door cover 383 may include the first door handle 387, which is formed in either a direction parallel to the bottom of the cabinet 1 or a direction perpendicular to the bottom of the cabinet 1. FIG. 10 illustrates a case in which the first door handle 387 is provided in the direction parallel to the bottom of the cabinet 1.

The second door 39 may include a second door frame 391 defining an external appearance of the second door 39, the second door handle 397 provided on at least one of two opposite ends of the second door frame 391, and a second door through-hole 393 perforated in the second door frame 391. The transparent plate 395 may be fitted into the second door through-hole 393.

The second door 39 may be secured to the first door 38 via the second door hinge 9. The second door hinge 9, as illustrated in FIG. 10A, may include a first door fixing plate 91 secured to the first door 38, a second door fixing plate 95 secured to the second door 39, and a second door rotating shaft 93 installed perpendicular to the bottom of the cabinet 1, the second door rotating shaft 93 o rotatably coupling the first door fixing plate 91 and the second door fixing plate 95.

It is noted that the above described configuration of the second door hinge 9 is given only by way of example and the second door hinge 9 may have various other configurations which may facilitate rotation of the second door 39.

Figure 12:
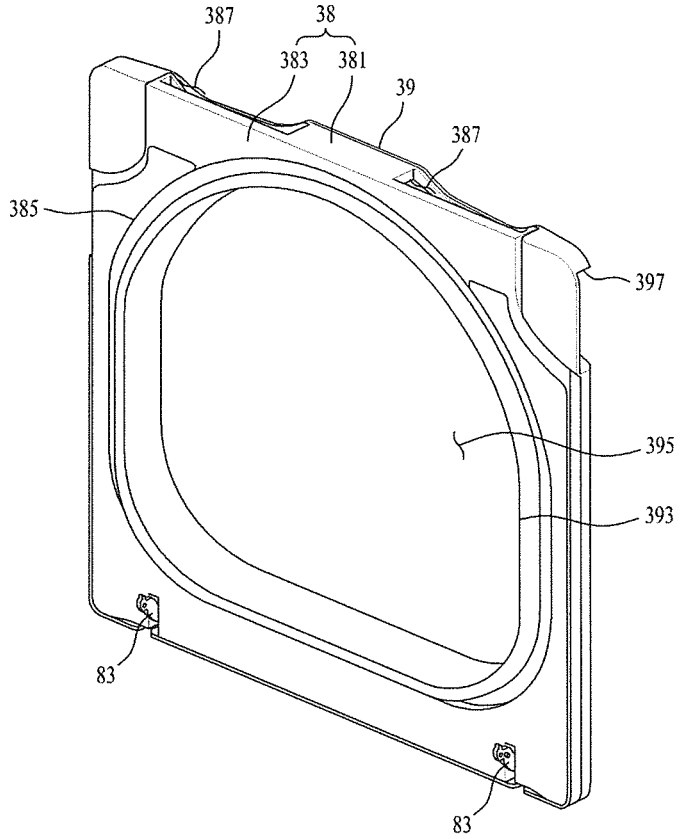
Figure 13:
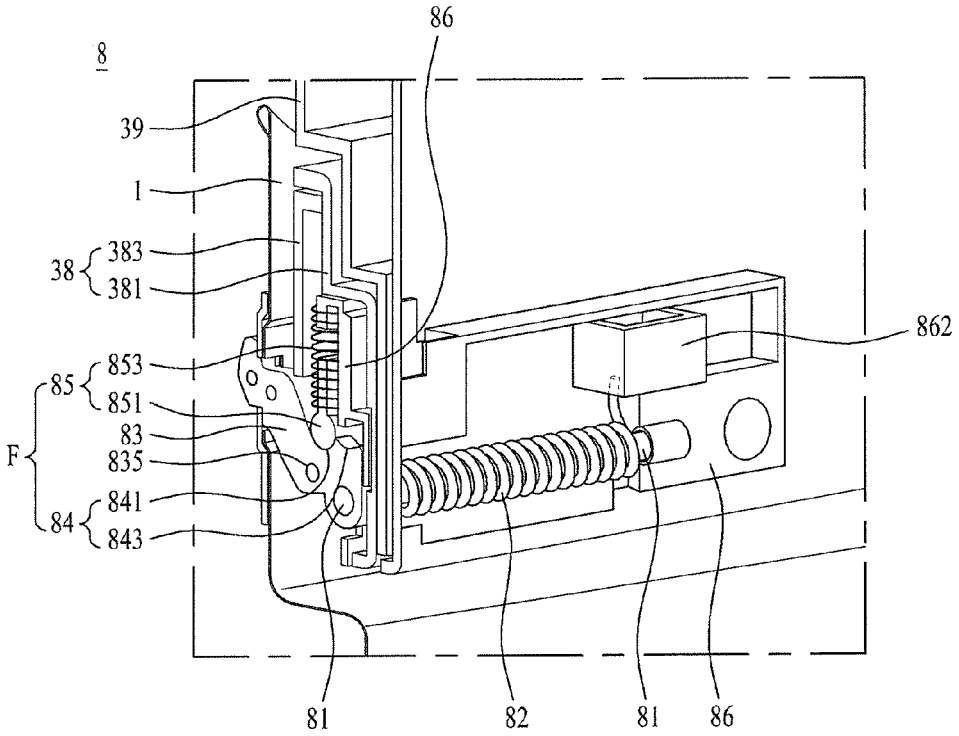
FIGS. 13, 14A, 14B and 14C illustrate a first door hinge.

As illustrated in FIGS. 12 and 13, the first door hinge 8 may include a first door rotating shaft 81 located between the first door frame 381 and the first door cover 383 so as to be arranged parallel to the bottom of the cabinet 1, and a rotating shaft supporter 83 having one end secured to the cabinet 1 and the other end coupled to the first door rotating shaft 81. The first door rotating shaft 81 may be coupled to the first door 38 to assist rotation of the first door 38. Accordingly, the first door 38 is rotatable about the first door rotating shaft 81.

The first door hinge 8 may also include an elastic door support piece 82 which allows the first door 38 to be rotated slowly when the user attempts to open the input opening 11 and to assist the user in rotating the first door 38 with low force when the user attempts to close the input opening 11. The elastic door support piece 82 may have various shapes to provide the above described function. FIG. 13 illustrates one example in which the elastic door support piece 82 is a torsion spring.

In this case, the torsion spring may be configured to surround an outer circumference of the first door rotating shaft 81. One end of the torsion spring may be secured to the first door 38 and the other end of the torsion spring may be secured to the rotating shaft supporter 83. To this end, the rotating shaft supporter 83 may have a spring fitting hole 835 into which one end of the torsion spring is inserted, and a hinge cover 86 may be provided on the first door to securely capture the other end of the torsion spring.

The laundry treatment apparatus 100 may also include an angle adjusting device F to adjust a rotating angle of the first door 38. The angle adjusting device F may include an adjusting member 84 provided at the rotating shaft supporter 83 or the first door rotating shaft 81, and a detachable member 85 provided at the first door 38 so as to be detachably coupled to the adjusting member 84. In the exemplary embodiment shown in FIG. 13, the adjusting member 84 is provided at the rotating shaft supporter 83 and the detachable member 85 is provided at the first door 38 so as to be detachably coupled to the adjusting member 84. In the exemplary embodiment shown in FIG. 17, the adjusting member 84 is provided at the first door rotating shaft 81 and the detachable member 85 is provided at the first door 38 so as to be detachably coupled to the adjusting member 84.

Although FIG. 13 illustrates the adjusting member 84 in the form of a plurality of recesses indented in an outer circumference of the rotating shaft supporter 83, the adjusting member 84 may take the form of a plurality of bosses protruding from the outer circumference of the rotating shaft supporter 83. Other arrangements may also be appropriate.

Assuming that the adjusting member 84 takes the form of a plurality of bosses protruding from the outer circumference of the rotating shaft supporter 83, it is noted that the detachable member 85 may take the form of a recess capable of receiving any one of the plurality of bosses provided at the rotating shaft supporter 83 when the first door 38 is rotated.

Specifically, the adjusting member 84 may include a first recess 841 and a second recess 843 formed in the outer circumference of the rotating shaft supporter 83 are spaced apart from each other by a predetermined distance. The first recess 841 may be located so as to be coupled with the detachable member 85 when the first door 38 closes the input opening 11, and the second recess 843 may be spaced apart from the first recess 841 by a first angle (for example, by 30 to 60 degrees, or 20 to 50 degrees).

The detachable member 85 may include a detachable member body 851 located in the first door 38 and configured to be inserted into the first recess 841 or the second recess 843, and an elastic body support piece 853 having one end secured to the detachable member body 851 and the other end secured to the first door 38.

Hereinafter, a procedure of adjusting a rotating angle of the first door 38 via the adjusting member 84 and the detachable member 85 will be described with reference to FIGS. 14A to 14C.

When the first door 38 closes the input opening 11, the detachable member body 851 is positioned in the first recess 841, thereby preventing the first door 38 from being unintentionally rotated in a state in which no external force is applied.

However, when the user applies external force to the first door 38 via the first door handle 387, the first door 38 is rotated about the first door rotating shaft 81. Since the detachable member body 851 is elastically supported by the first door 38 via the elastic body support piece 853, the detachable member body 851 moves from the first recess 841 to the second recess 842 of the adjusting member 84 when the first door 38 is rotated.

Figure 14A:
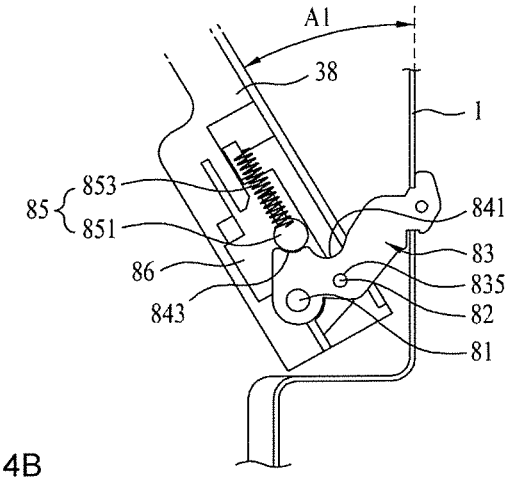

Once the detachable member body 851 has been inserted into the second recess 843, a position of the first door 38 may be maintained at the first angle A1 as illustrated in FIG. 14A. In this position, the first door 38 may guide laundry toward the input opening 11 and into the storage space S.

Figure 14B:
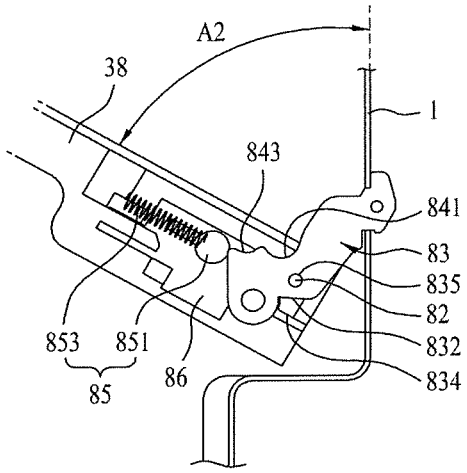
Figure 14C:
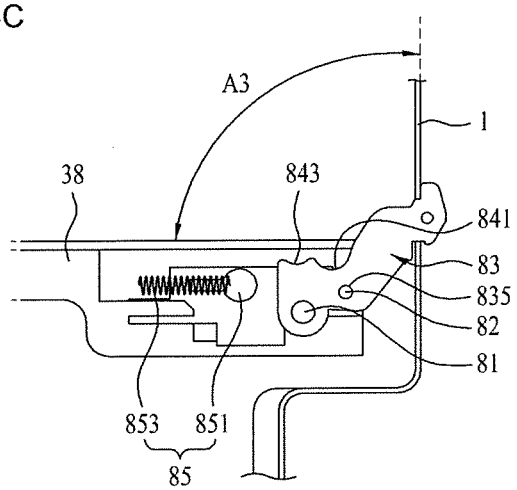

When the user applies additional external force to the first door 38, the first door 38 may rotate further from the cabinet 1 by the second angle A2 (60 to 90 degrees) as illustrated in FIGS. 14B and 14C.

Once the first door 38 has been rotated by the second angle A2, the user may place laundry removed from the storage space S on the first door 38. That is, the first door 38 may serve as a shelf when removing laundry from the storage space S. To this end, the rotating shaft supporter 83 may be configured to support the first door 38 when the first door 38 is rotated by the second angle A2.

The rotating shaft supporter 83 may include a first stopper 832 to prevent further rotation of the first door 38 beyond the upper limit of the second angle A2. The first door 38 may include a second stopper 834 configured to come into contact with the first stopper 832 when the first door 38 is rotated by the second angle A2.

Rotation of the first door 38 from the cabinet 1 by the second angle A2 may be realized via the elastic door support piece 82. The elastic door support piece 82 may be, for example, a tension spring or a torsion spring. If the elastic door support piece 82 is a tension spring, and the tension spring is not further extended once the first door 38 has been rotated by the second angle A2, a position of the first door 38 may be maintained at the second angle A2. If the elastic door support piece 82 is a torsion spring, and an inner circumference of the torsion spring comes into contact with the outer circumference of the first door rotating shaft 81 once the first door 38 has been rotated by the second angle A2, a position of the first door 38 may be maintained at the second angle A2.

Figure 15A:
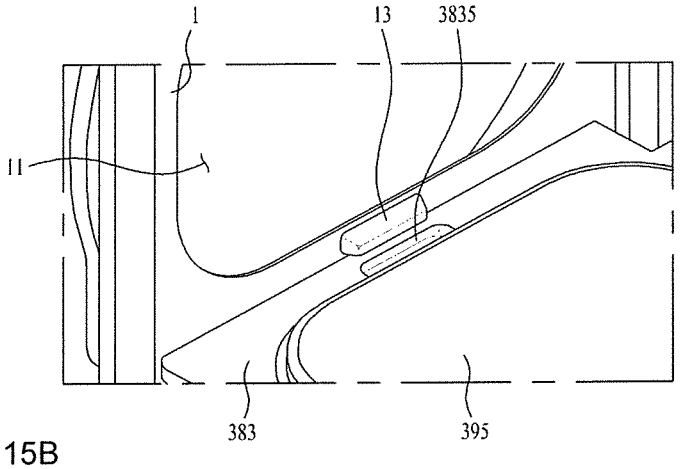
FIGS. 15A and 15B illustrate a door support protrusion to support a first door.
Figure 15B:
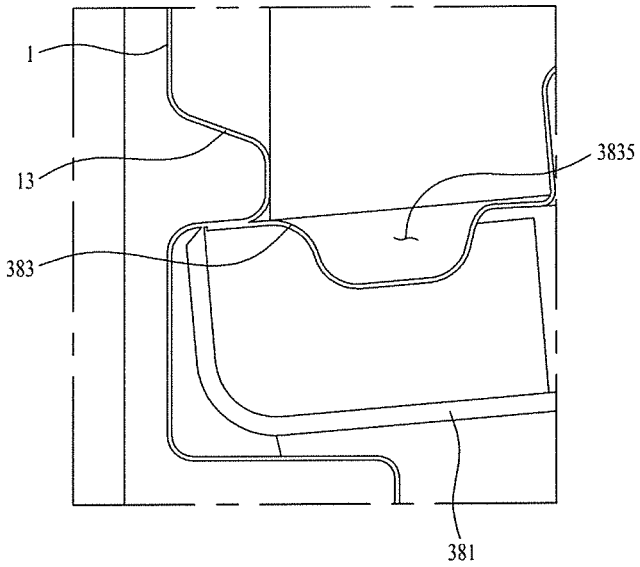

As shown in FIG. 15, a door support protrusion 13 may be provided at the cabinet 1 and a support protrusion receiving recess 3835 may be provided at the first door cover 383. The door support protrusion 13 may come into contact with a corresponding portion of the first door 38 when the first door 38 is rotated by the second angle A2, thereby preventing the first door 38 from being rotated beyond the second angle A2. The support protrusion receiving recess 3835 provides a space in which the door support protrusion 13 is received when the first door 38 closes the input opening 111.

Furthermore, the elastic door support piece 82 of the first door hinge 8 may provide sufficient elastic force to fix a position of the first door 38 between the first angle A1 and the second angle A2, as shown in FIG. 14B, and thus the first door 38 may be kept in a rotated state from the cabinet 1 by a third angle A3, as shown in FIG. 14C.

The first door hinge 8 may also include a hinge cover 86 to secure the first door rotating shaft 81 to the first door frame 381. Alternatively, if the elastic door support piece 82 is a torsion spring, the hinge cover 86 may be configured to secure both the first door rotating shaft 81 and the elastic door support piece 82 to the first door frame 381.

Figure 16:
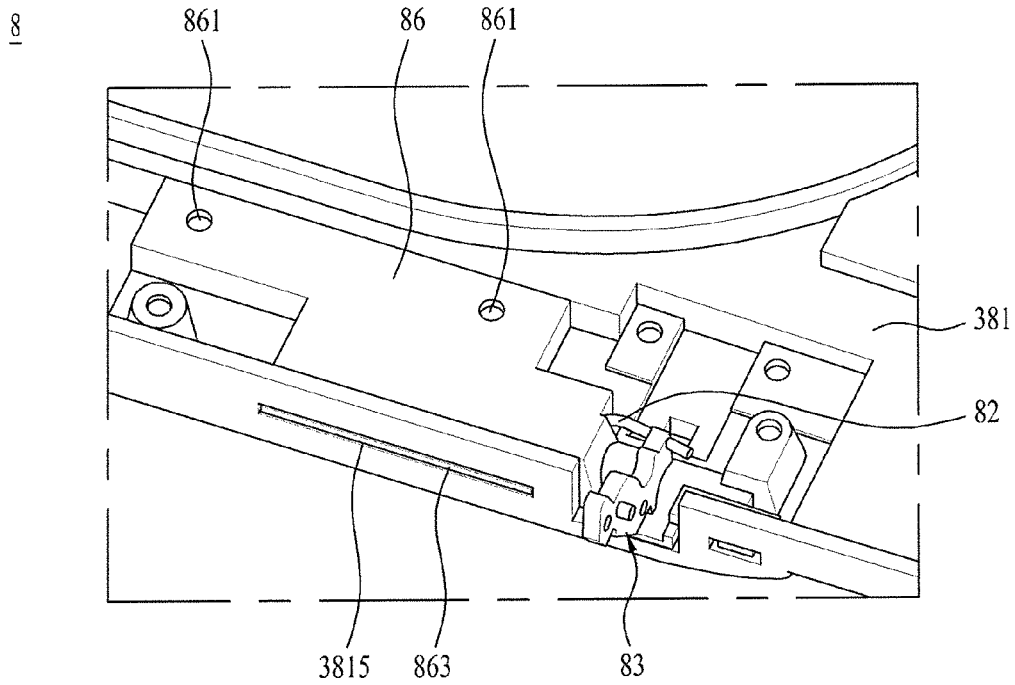
FIG. 16 illustrates a hinge cover.

As illustrated in FIG. 16, the hinge cover 86 may include a fastening member penetrating hole 861 that receives a fastening member, such as, for example, a bolt, and a rib 863 configured to be coupled to the first door frame 381. The rib 863 may be inserted into a slit 3815 formed in a lower portion of the first door frame 381 to facilitate assembly of the hinge cover 86 and firm coupling between the first door rotating shaft 81 and the first door frame 381.

Since a plurality of components, including the first door rotating shaft 81 and the elastic door support piece 82, my be located in the hinge cover 86, a position of the fastening member penetrating hole 861 may be somewhat limited by a position of the first door rotating shaft 81. In such a situation, the rib 863 may firmly secure the aforementioned components located in the hinge cover 86 to the first door frame 381 without interfering with the internal components of the hinge cover 86.

As shown in FIG. 13, if the first door hinge 8 includes the hinge cover 86, the elastic door support piece 82 may be secured to the first door 38 via a spring holder 862 provided at the hinge cover 86, and the elastic body support piece 853 provided at the detachable member 85 may be secured to the first door 38 via the hinge cover 86.

Figure 17:
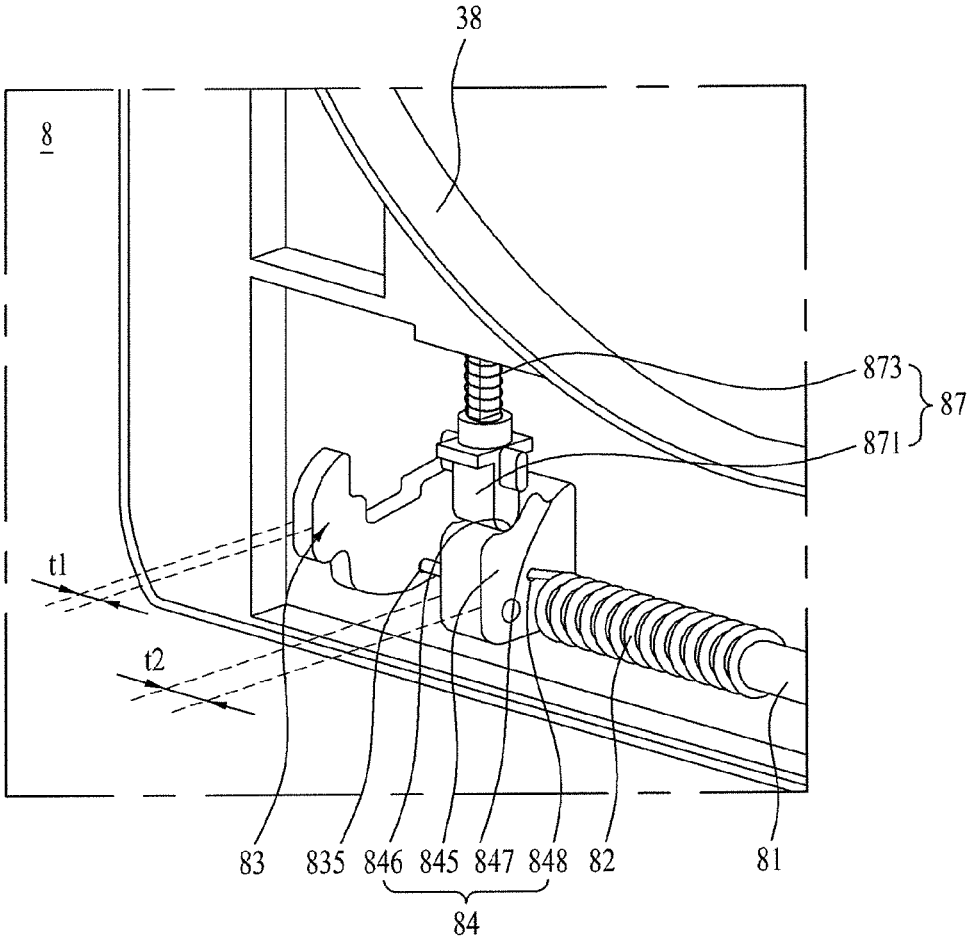
FIG. 17 illustrates another embodiment of the first door hinge.

FIG. 17 illustrates another embodiment of the first door hinge 8. In the first door hinge 8 shown in FIG. 13, the adjusting member 84 is provided at the outer circumference of the rotating shaft supporter 83, and, in certain circumstances, may not provide sufficient coupling force to the detachable member 85 if the rotating shaft supporter 83 is relatively thin. in contrast, the adjusting member 84 illustrated in FIG. 17 includes an adjusting member body 845 installed at the first door rotating shaft 81 and separated from the rotating shaft supporter 83.

The adjusting member body 845 may include a first recess 846 and a second recess 847 formed in an outer circumference thereof, the first recess 846 and the second recess 847 being spaced apart from each other by a predetermined distance.

the embodiment shown in FIG. 17, a thickness t2 of the adjusting member body 845 may be greater than a thickness t1 of the rotating shaft supporter 83. However, in alternative embodiments, the adjusting member body 845 may be configured such that only a portion thereof where the first recess 846 and the second recess 847 are formed has a thickness greater than the thickness t1 of the rotating shaft supporter 83.

The adjusting member body 845 may also include a spring fitting hole 848 into which one end of the elastic door support piece 82 is inserted. Accordingly, the elastic door support piece 82 may be secured to the first door rotating shaft 81 by being inserted into at least one of the spring fitting hole 835 provided at the rotating shaft supporter 83 or the spring fitting hole 848 provided at the adjusting member body 845.

A detachable member 87 may include a detachable member body 871 located in the first door 38 and configured to be inserted into the first recess 846 or the second recess 847, and an elastic body support piece 873 having one end secured to the first door 38 and the other end secured to the detachable member body 871.

Accordingly, when the detachable member body 871 is inserted into the first recess 846, the first door 38 may be maintained in a closed position with respect to the input opening 11. When the detachable member body 871 is inserted into the second recess 847, the first door 38 may be ke positioned at a first angle with respect to the cabinet 1.

A position of the first door 38 may be maintained at a second angle via the rotating shaft supporter 83 or the elastic door support piece 82. Also, a position of the first door 38 may be maintained at a third angle using elastic force of the elastic door support piece 82. Here, the third angle may be defined as an angle between the first angle and the second angle. Features of the rotating shaft supporter 83 and the elastic door support piece 82 which maintain the first door 38 at the second angle or the third angle have been described above and thus, a detailed description thereof will be omitted hereinafter.

Figure 18:
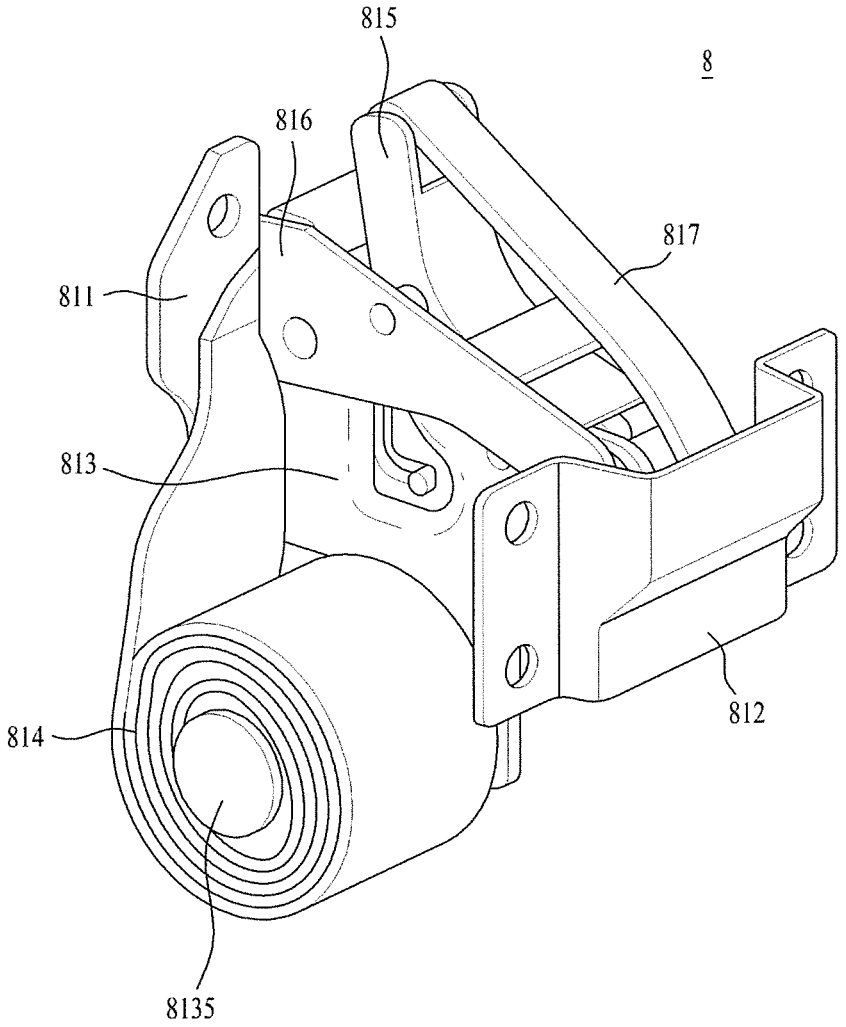
FIGS. 18, 19 and 20A-20C illustrate still another embodiment of the first door hinge.
Figure 19:
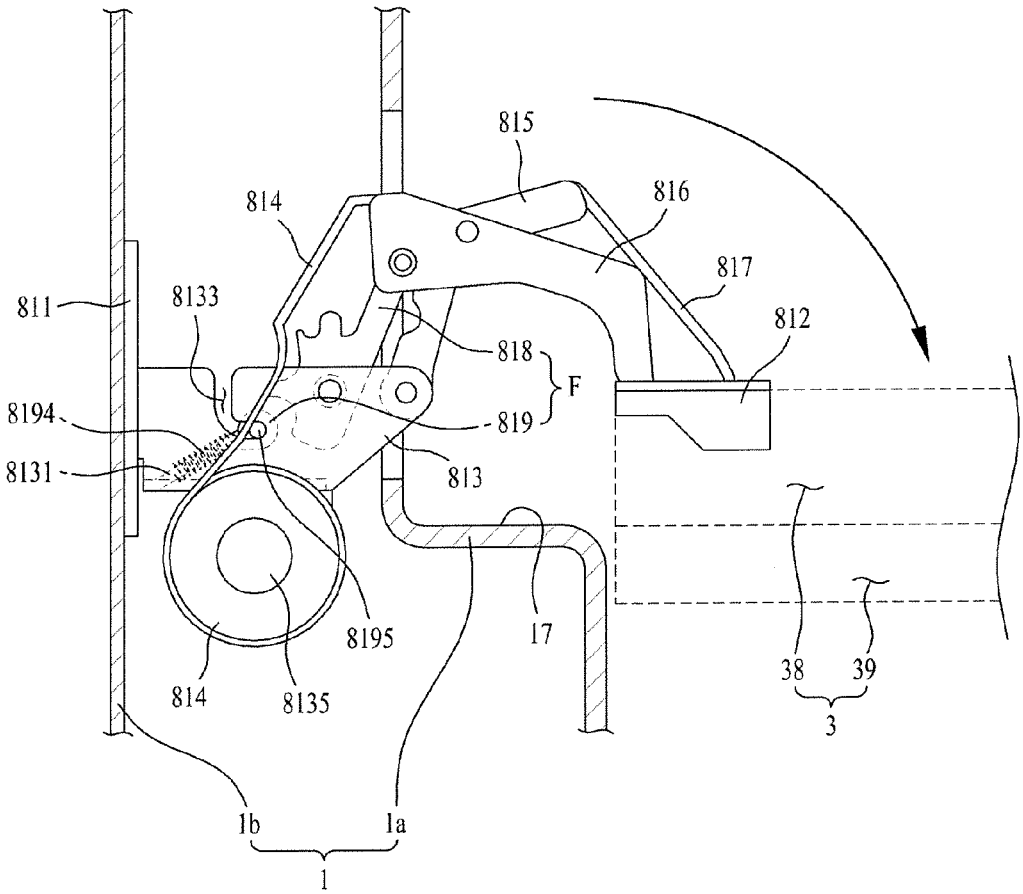

FIGS. 18 and 19 illustrate still another embodiment of the first door hinge 8. in the embodiment shown in FIGS. 18 and 19, the first door hinge 8 may prevent the lower portion of the first door 38 from interfering with the cabinet 1 when the first door 38 is rotated about a rotating shaft installed parallel to the bottom of the cabinet 1. The cabinet 1 of the laundry treatment apparatus as embodied and broadly described herein may include an outer cabinet 1*a* defining an external appearance of the cabinet 1 and an inner cabinet 1*b* spaced apart from the outer cabinet 1*a* by a predetermined distance. In this case, the first door hinge 8 may include a cabinet fixing piece 811, or cabinet bracket 811, secured to the inner cabinet 1*b*, a door fixing piece 812, or door bracket 812, secured to the first door 38, a base plate 813 protruding from the cabinet fixing piece 811 toward the outer cabinet 1*a*, and a link mechanism 815, 816 and 817 to rotatably secure the first door 38 to the base plate 813. The link mechanism shown in FIGS. 18 and 19 includes a first link 815 rotatably secured to the base plate 813, a second link 816 rotatably secured to the first link 815, with one end of the second link 816 secured to the door fixing piece 812, and a third link 817 having one end secured to the first link 815 and the other end secured to the door fixing piece 812. A free end of the second link 816 is supported by a spiral spring 814. The spiral spring 814 is wound on a spring fixing shaft 8135 provided at the base plate 813 such that one end of the spiral spring 814 is secured to the free end of the second link 816.

Accordingly, when an external force is applied to the first door 38 so as to open the input opening 11, as shown in FIG. 19, the first link 815 coupled to the base plate 813 is rotated clockwise, and the second link 816 and the third link 817 secured to the first link 815 are moved away from the inner cabinet 1*b*. As the second link 816 and the third link 817 are moved away from the inner cabinet 1*b*, the first door 38 secured to both the second link 816 and the third link 817 are moved away from the outer cabinet 1*a*, which may prevent a lower end of the first door 38 from interfering with the outer cabinet 1*a*.

This interference preventing effect may be more pronounced when the outer cabinet 1*a* includes a door receiving region 17 configured to receive the door 3 therein. Specifically, if the outer cabinet 1*a* includes the door receiving region 17 configured to receive the door 3 therein, the lower end of the door 3 may interfere with the door receiving region 17 upon rotation of the first door 38 due to a thickness of the door 3. This embodiment of the first door hinge 8 may alleviate this interference problem.

The first door hinge 8 may also include the angle adjusting unit F to adjust a rotating angle of the first door 38. The angle adjusting unit F may include an adjusting link 818 to connect the base plate 813 and the second link 816 to each other, and a detachable member 819 provided at the base plate 813 so as to be detachably coupled to the adjusting link 818.

Figure 20A:
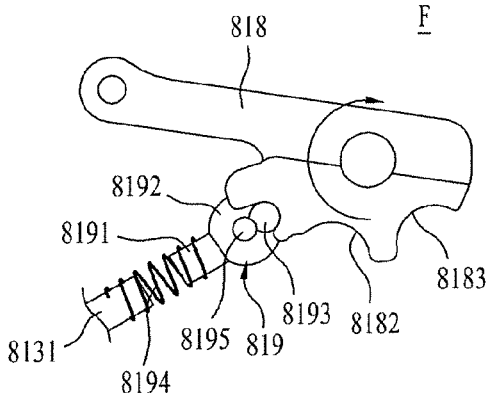
Figure 20B:
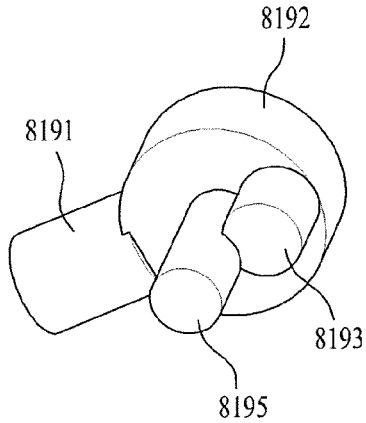
Figure 20C:
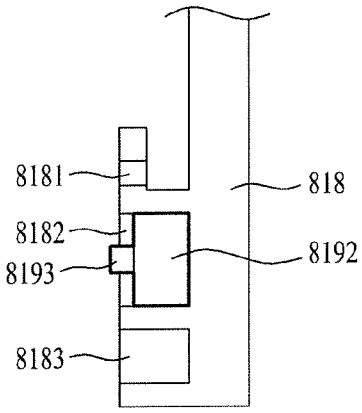

As illustrated in FIGS. 20A-20C, the adjusting link 818 may have a bar shape. One end of the adjusting link 818 may be rotatably secured to the base plate 813 and the other end of the adjusting link 818 may be rotatably secured to the second link 816. In particular, one end of the adjusting link 818 may be secured to the base plate 813 at a position between the cabinet fixing piece 811 and the first link 815.

The adjusting link 818 may include a first recess 8181, a second recess 8182 spaced apart from the first recess 8181 by a predetermined distance, the second recess 8182 having a diameter greater than a diameter of the first recess 8181, and a third recess 8183 spaced apart from the second recess 8182 by a predetermined distance, the third recess 8183 having the same diameter as that of the second recess 8182.

The detachable member 819 may include a detachable member body 8191 and an elastic support piece 8194 having one end secured to the base plate 813 and the other end secured to the detachable member body 8191. To this end, the base plate 813 may also include a spring fixing protrusion 8131 to which the elastic support piece 8194 may be secured.

The detachable member body 8191 may include a first fixing protrusion 8192 having, for example, a disc shape and a second protrusion 8193 provided at a surface of the first fixing protrusion 8192. The second fixing protrusion 8193 may be sized so as to be detachably inserted into the first recess 8181 and that the first fixing protrusion 8192 may be sized so as to be detachably inserted into the second recess 8182 and the third recess 8183. When the first door 38 closes the input opening 11, the second fixing protrusion 8193 is received in the first recess 8181 of the adjusting link 818, thereby preventing the first door 38 from being unintentionally rotated to open the input opening 11, as long as no external force is applied to the first door 38.

When an external force is applied to the first door 38 so that the first door 38 is rotated away from the input opening 11 in the cabinet 1, the adjusting link 818 is rotated clockwise. As the adjusting link 818 is rotated clockwise, the second fixing protrusion 8193 is separated from the first recess 8181 and the first fixing protrusion 8192 is inserted into the second recess 8182. Thus, a position of the first door 38 may be maintained at a first angle (such as, for example, 30 to 60 degrees, or 20 to 50 degrees) to guide laundry into the storage space S.

When another external force is applied to the first door 38 that is positioned at the first angle so as to rotate the first door 38 further away from the cabinet 1, the adjusting link 818 is further rotated clockwise and the first fixing protrusion 8192 is inserted into the third recess 8183. Once the first fixing protrusion 8192 has been inserted into the third recess 8183, a position of the first door 38 is maintained at a second angle (60 to 90 degrees) as illustrated in FIG. 19. In this way, the first door 38 may function as a shelf to support laundry when the laundry is removed from the storage space S.

The detachable member 819 may also include a base fixing protrusion 8195 configured to be coupled to the base plate 813. In this case, the base plate 813 may also include a fixing protrusion receiving recess 8133, as shown in FIG. 19, in which the base fixing protrusion 8195 may be received. In this case, the base fixing protrusion 8195 may protrude from one surface of the first fixing protrusion 8192. The fixing protrusion receiving recess 8133 may be formed in the base plate 813 by different methods, including, for example, cutting.

Figure 21:
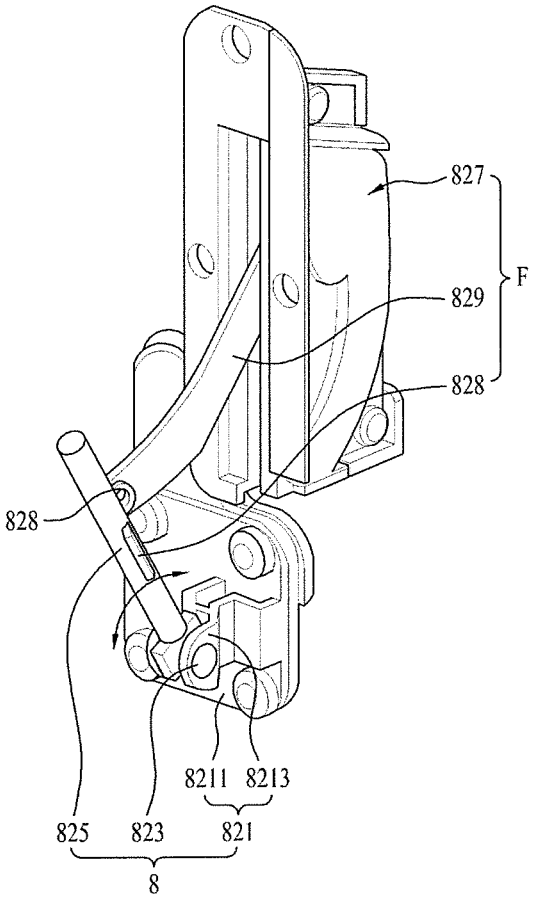
FIGS. 21 to 23 illustrate another embodiment of the first door hinge.
Figure 22:
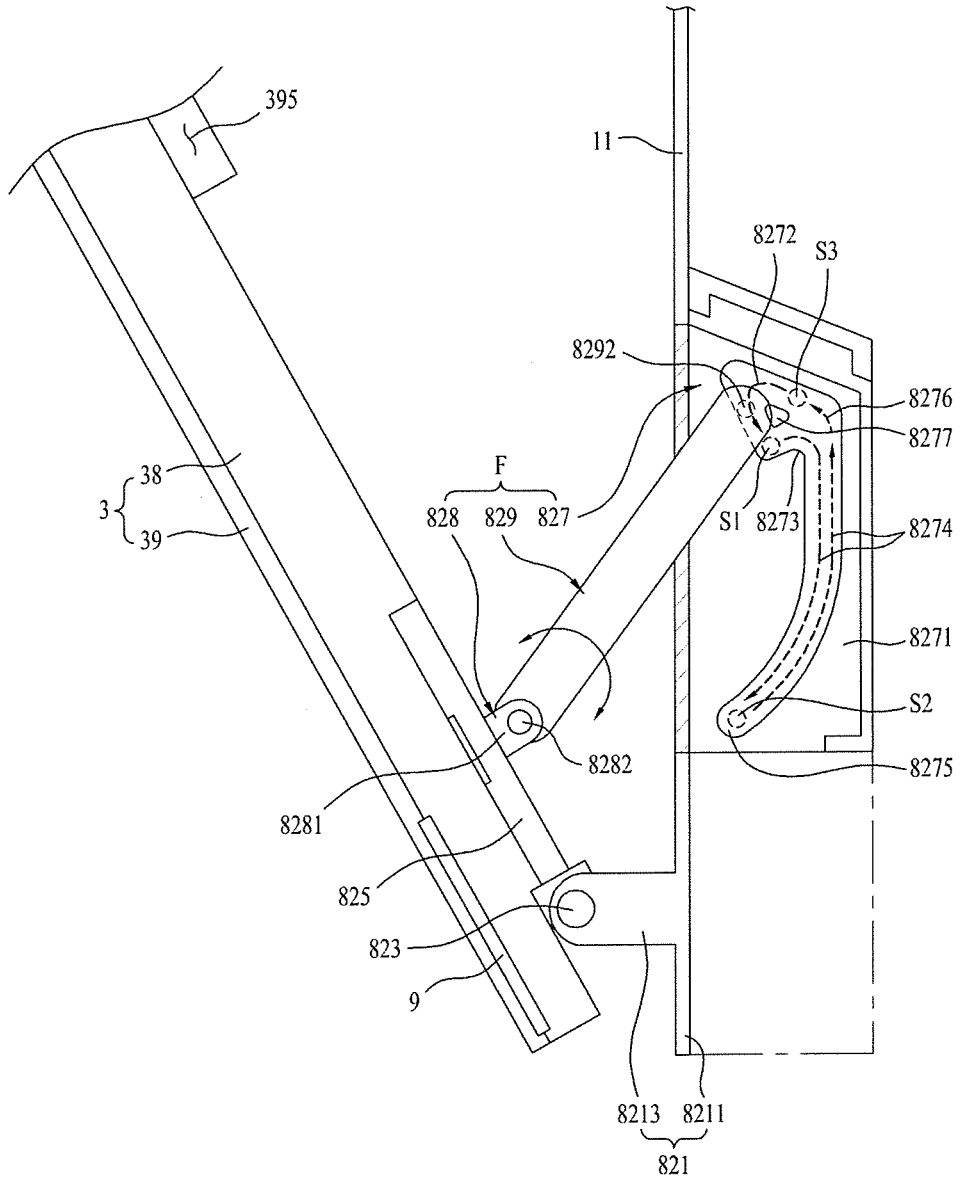

FIGS. 21 and 22 illustrate another embodiment of the first door hinge 8 of the laundry treatment apparatus as embodied and broadly described herein. The door 3 may be a single door, or the door 3 may include the first door 38 rotatably secured to the cabinet 1 and the second door 39 rotatably secured to the first door 38. Assuming that the door 3 including the first door 38 and the second door 39 are provided, as shown in FIG. 22, the first door 38 has the first door through-hole 385 corresponding to the input opening 11 and the second door 39 is configured to open or close the first door through-hole 385. Accordingly, the user may open the input opening 11 via the first door 38, or may open the input opening 11 via the second door 39.

Moreover, as discussed above, the first door 38 and the second door 39 may have a difference in terms of at least one of a rotating direction and/or a maximum rotating angle thereof. For example, the first door 38 and the second door 39 may respectively include rotating shafts parallel to each other and a maximum rotating angle of the first door 38 may be greater than a maximum rotating angle of the second door 39. Further, the first door 38 and the second door 39 may have different rotating directions. In this case, the first door 38 may be rotated about a rotating shaft installed parallel to the bottom of the cabinet 1 and the second door 39 may be rotated about a rotating shaft installed perpendicular to the bottom of the cabinet 1.

Thus, a laundry treatment apparatus as embodied and broadly described herein may include the first door hinge 8 to secure the first door 38 to the cabinet 1 and the second door hinge 9 to secure the second door 39 to the first door 38. The second door hinge 9 may have various shapes capable of securing the second door 39 such that the second door 39 is rotated about a rotating shaft installed perpendicular to the bottom of the cabinet 1. One exemplary configuration of the second door hinge 9 was been described above with reference to FIG. 10.

The first door hinge 8 may include a cabinet fixing piece 821, or cabinet bracket 821, secured to the cabinet 1, a door fixing piece 825, or door bracket 825, secured to the first door 38, and a first door rotating shaft 823 arranged parallel to the bottom of the cabinet 1, the first door rotating shaft 823 rotatably coupling the door fixing piece 825 and the cabinet fixing piece 821 to each other. The cabinet fixing piece 821 may include a cabinet fixing plate 8211 secured to the cabinet 1, and a shaft fixing rib 8213 provided at the cabinet fixing plate 8211 such that the first door rotating shaft 823 is secured to the shaft fixing rib 8213. The door fixing piece 825 may take the form of, for example, a cylindrical column to which the first door 38 may be secured. In this case, the first door rotating shaft 823 may protrude from one end of the door fixing piece 825.

The laundry treatment apparatus may also include the angle adjusting unit F to adjust a rotating angle of the first door 38. The angle adjusting unit F may include a guider 827 provided at the cabinet 1 and a connector 829 having one end secured to the door fixing piece 825 and the other end coupled to the guider 827. The connector 829 may include a connector body 8291 having, for example, a bar shape and a connector protrusion 8292 provided at the connector body 8291 so as to be coupled to the guider 827.

The connector body 8291 may be rotatably secured to the door fixing piece 825 via a connector fixing piece 828. The connector fixing piece 828 may include a fixing piece body 8281 coupled to the door fixing piece 825, and a connector connecting shaft 8282 to couple the fixing piece body 8281 and the connector body 8291 to each other.

The guider 827 may include a guider body 8271 secured to the cabinet 1, and a first guiding groove 8272, a second guiding groove 8274 and a third guiding groove 8276 formed in the guider body 8271. The first guiding groove 8272, the second guiding groove 8274 and the third guiding groove 8276 may be connected to each other so as to guide movement of a connector protrusion 8292 provided at the connector body 8291.

The second guiding groove 8274 may extend in a height direction of the cabinet 1, i.e., vertically, and may include a second seating portion 8275 at a lowermost end thereof. A lower portion of the second guiding groove 8274 may be bent toward the first door 38 to facilitate rotation of the first door 38.

The third guiding groove 8276 may extend from an upper end of the second guiding groove 8274 toward the first door 38 and may connect the third guiding groove 8276 and the second guiding groove 8274 to each other. The third guiding groove 8276 may be separated from the second guiding groove 8274, with a first seating portion 8273 interposed therebetween. A guiding protrusion 8277 may guide movement of the connector protrusion 8292 by adjusting widths of the first guiding groove 8272 and the third guiding groove 8276. The connector protrusion 8292 is located at a position S3 when the first door 38 closes the input opening 11. If the user applies external force to the first door 38, the first door 38 is rotated about the first door rotating shaft 823, and the connector protrusion 8292 is moved from the third guiding groove 8276 into the first guiding groove 8272 under guidance of the guiding protrusion 8277.

The connector protrusion 8292 introduced into the first guiding groove 8272 is supported by the first seating portion 8273. When the connector protrusion 8292 is located at a position S1, a position of the first door 38 is maintained at a first angle (for example, 30 to 60 degrees, or 20 to 50 degrees), allowing the first door 38 to guide laundry toward the input opening 11.

If the user again pushes the first door 38 to further rotate the first door 38, the connector protrusion 8292 is separated from the first seating portion 8273, and thereafter is introduced into the second guiding groove 8274 due to gravity. Once the connector protrusion 8292 has been introduced into the second guiding groove 8274, the first door 38 is rotated until the connector protrusion 8292 is supported on the second seating portion 8275 (i.e. until the connector protrusion 8292 is located at position S2). Then, once the connector protrusion 8292 is at the position S2, a position of the first door 38 may be maintained at a second angle (60 to 90 degrees), so that the first door 38 may function as a shelf to support laundry removed from the storage space S.

If instead, the user wants to rotate the first door 38 from the first angle back toward the cabinet 1 to close the first door 38, rather than further rotating the first door 38 to the second angle, the user may simply push the first door 38 toward the cabinet 1 to move the connector protrusion 8292 from the position S1 to the position S3.

Similarly, if the user wants to rotate the first door from the second angle back toward the cabinet 1 to close the input opening 11, the user may simply push the first door 38 toward the cabinet 1 to move the connector protrusion 8292 from the position S2 to the position S3.

Figure 23:
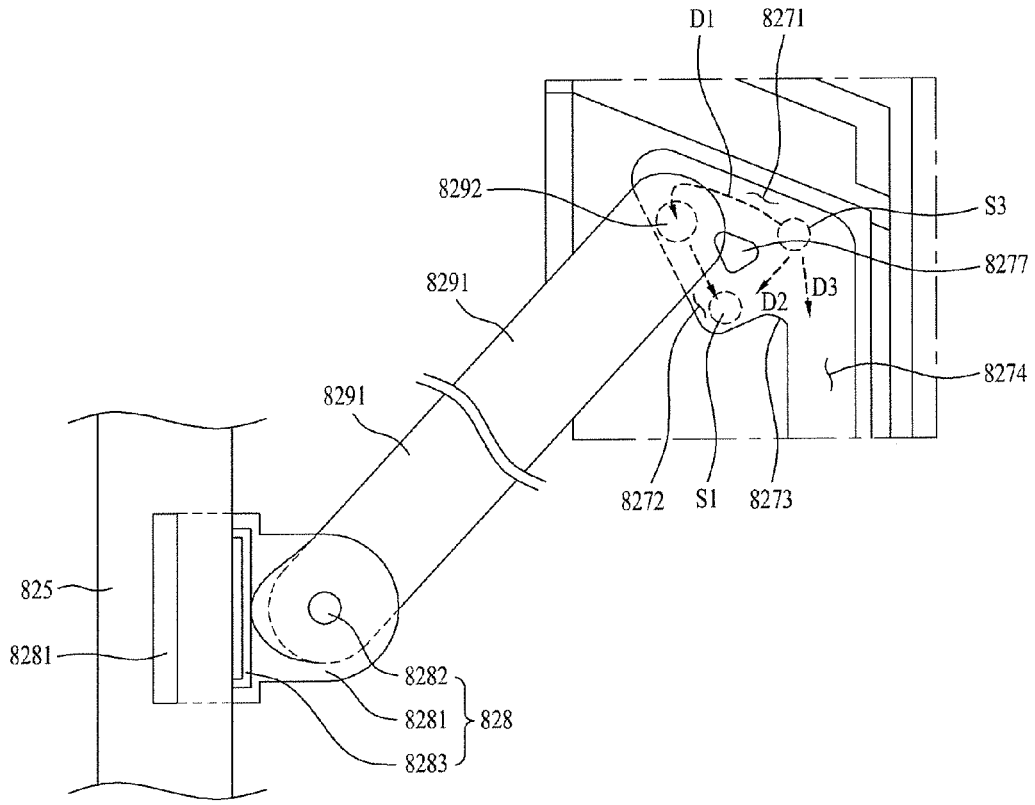

As illustrated in FIG. 23, when the first door 38 is positioned at the first angle, the connector protrusion 8292 may be unintentionally moved from the position S3 to the position S1 via a path D2, or may be moved from the position S3 to the position S2 via a path D3, rather than being moved from the position S3 to the position S1 via a path D1. To solve this problem, the connector body 8291 may also include a position fixing protrusion 8293 which comes into contact with the connector fixing piece 828 when the first door 38 closes the input opening 11, thereby temporarily fixing a position of the connector body 8291.

The position fixing protrusion 8293 may protrude from one end of the connector body 8291. The position fixing protrusion 8293 may interfere with the fixing piece body 8281 when the first door 38 closes the input opening 11, but does not interfere with the fixing piece body 8281 when the first door 38 begins to rotate. Accordingly, when the first door 38 begins to rotate, a position of the connector body 8291 is temporarily fixed, and the connector protrusion 8292 provided at the connector body 8291 is moved from the position S3 to the position S1 via the path D1 under guidance of the guiding protrusion 8277. The fixing piece body 8281 may include an elastic connector support piece 8283 configured to interfere with the position fixing protrusion 8293 provided at the connector body 8291, thereby elastically supporting the position fixing protrusion 8293.

Although the above described guider body 8271 may be provided as a separate member, as illustrated in FIG. 22, the guider body 8271 may include a guiding groove and a guiding protrusion formed at an inner circumferential surface of the cabinet 1.

Although the various embodiments of the first door hinge 8 shown in FIGS. 13, 17 and 18 have been described above based on the case in which the laundry treatment apparatus is provided with at least two doors, the first door hinge 8 as embodied and broadly described herein may be applied to a laundry treatment apparatus having a single door as illustrated in FIG. 1.

Moreover, although the angle adjusting unit has been described above based on the case in which the angle adjusting unit adjusts a rotating angle of the first door, the angle adjusting unit may adjust a rotating angle of the second door.

In a laundry treatment apparatus including two doors, as embodied and broadly described herein, a user may open the input opening 11 using either one of the two doors. Therefore, a device to prevent unintended rotation of one of the two doors during the intended rotation of the other door may be advantageous.

Hereinafter, a locking mechanism which prevents rotation of the second door 39 during rotation of the first door 38, and which prevents rotation of the first door 38 during rotation of the second door 39, will be described.

Figure 24:
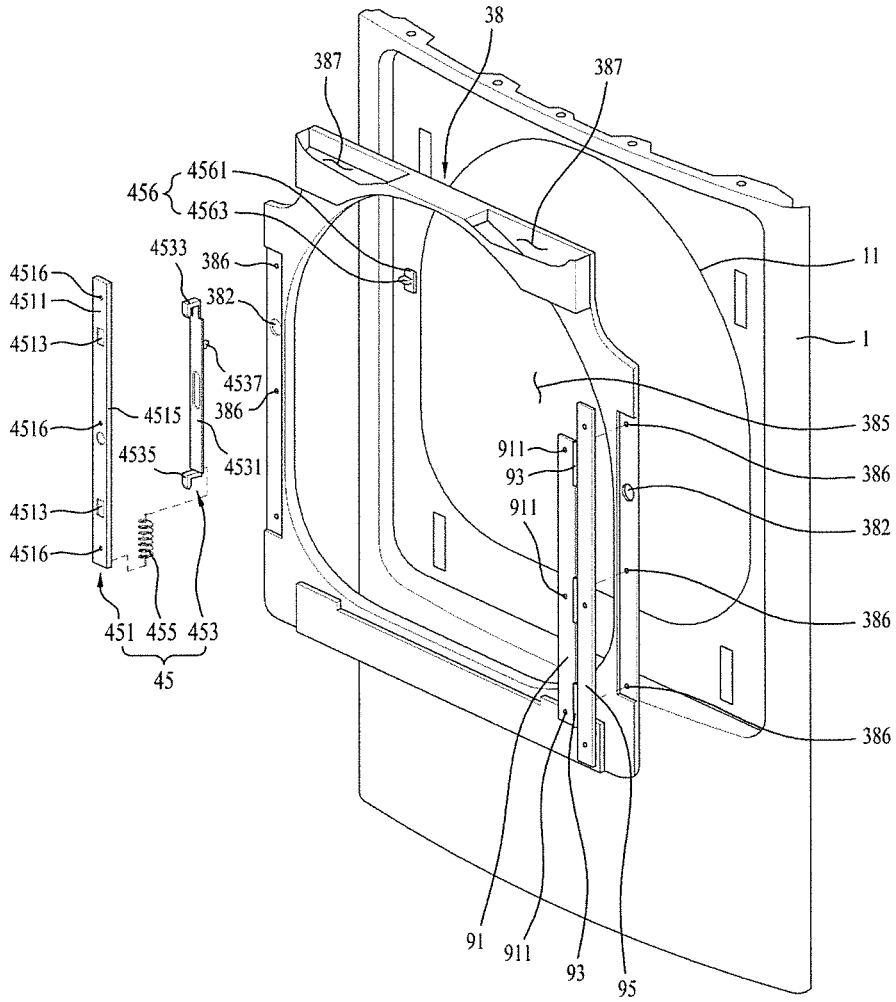
FIGS. 24 to 26 illustrate a second door holder.
Figure 27:
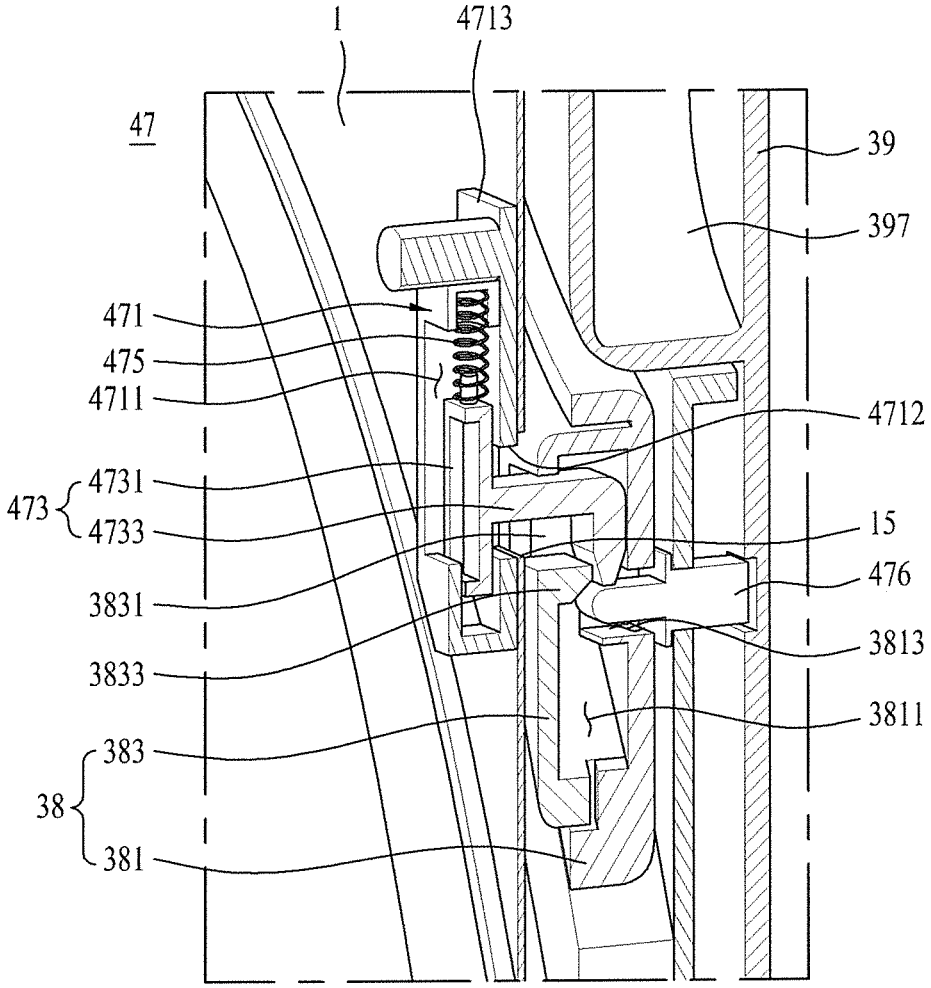
FIGS. 27 and 28 illustrate a first door holder.

As shown in FIGS. 24 and 27, the locking mechanism may include a second door holder 45 to prevent the second door 39 from being separated from the first door 38 during rotation of the first door 38, and a first door holder 47 to prevent the first door 38 from being separated from the cabinet 1 during rotation of the second door 39. More specifically, as shown in FIG. 24, the second door holder 45 may move so as to be coupled to the second door 39 when the first door 38 is rotated to open the input opening 11, and may move so as to be separated from the second door 39 when the first door 38 is rotated to close the input opening 11.

To this end, the second door holder 45 may include a second holder 453 located between the first door 38 and the second door 39 and detachably coupled to the second door 39, a second holder receptacle 451 located at a surface of the first door 38 to guide movement of the second holder 453, a second holder support piece 455 having one end secured to the second holder 453 and the other end secured to the second holder receptacle 451, and a holder pressure piece 456 provided at the cabinet 1 to move the second holder 453.

The second holder receptacle 451 may include a receptacle body 4511 arranged parallel to the surface of the first door 38, through-holes 4513 perforated in the receptacle body 4511, a guide rib 4515 provided at a rear surface of the receptacle body 4511 so as to define a space for receiving the second holder 453, and a fastening hole 4516 into which a fastening member to secure the receptacle body 4511 to the first door 38 is inserted.

In this embodiment, the first door 38 may have a fastening hole 386 provided at a position corresponding to the fastening hole 4516.

The second holder 453 may include a second holder body 4531 configured to be received in the space defined by the guide rib 4515 so as to be reciprocally movable in the second holder receptacle 451, hooks 4533 and 4535 which protrude from the second holder body 4531 so as to be respectively inserted into the through-holes 4513, and a holder protrusion 4537 provided at the second holder body 4531 so as to protrude toward the first door 38.

In this embodiment, the first door 38 may also include a holder protrusion penetrating hole 382 in which the holder protrusion 4537 may be received. The holder protrusion penetrating hole 382 and the fastening hole 386 may be provided at opposite ends of the first door 38, with the first door through-hole 385 interposed therebetween.

In particular, the fastening hole 386 provided at the first door 38 may be located at a position corresponding to a fastening hole 911 provided at the second door hinge 9. This may provide for change of the positions of the second door hinge 9 and the second door holder 45 as necessary.

Assuming that the second door hinge 9 is located at the left side in the exemplary arrangement shown in FIG. 24, the second door 39 may be rotated about the left side of the first door 38. Similarly, assuming that the second door hinge 9 is located at the right side of the exemplary arrangement shown in FIG. 24, the second door 39 may be rotated about the right side of the first door 38. Therefore, it is possible to change a rotating direction of the second door 39 as necessary to accommodate a particular installation environment.

Figure 25:
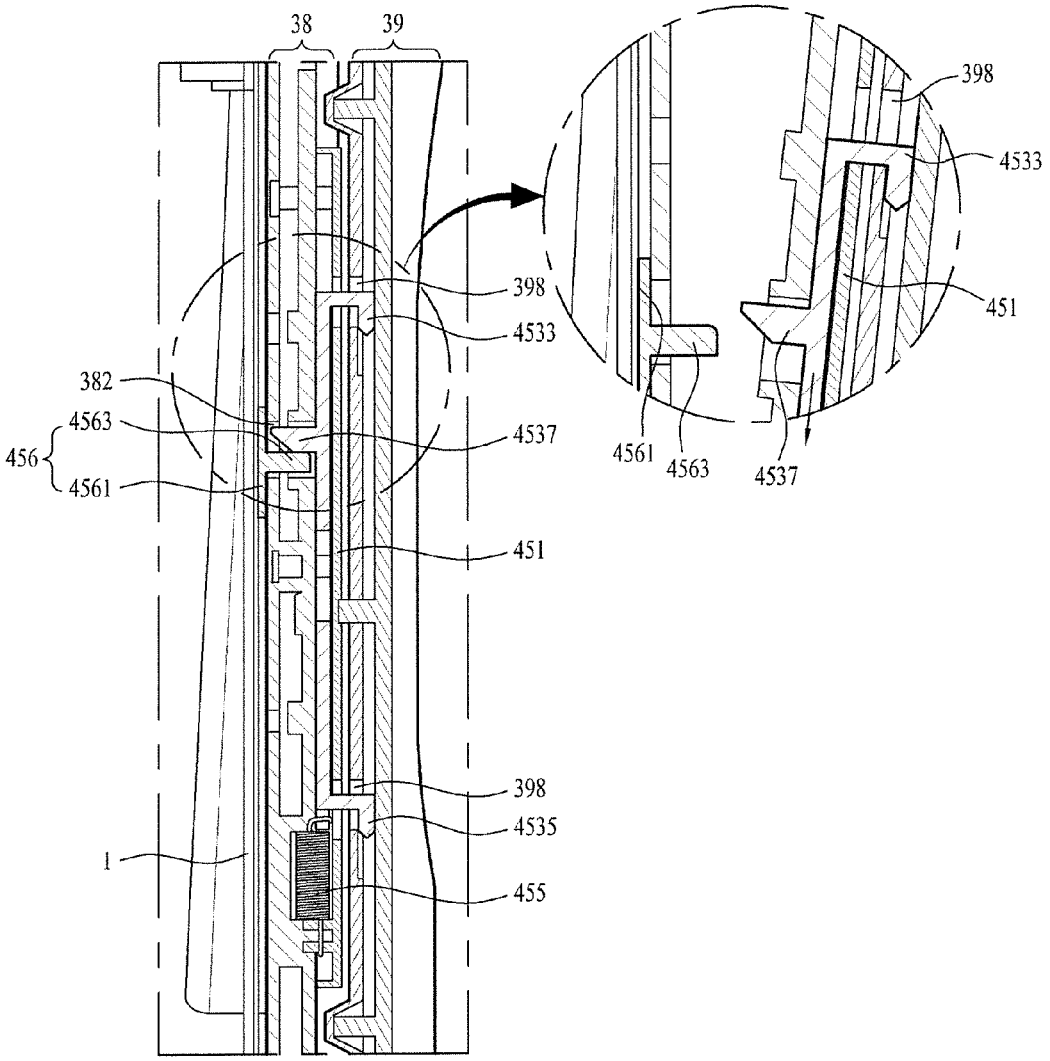

The hooks provided at the second holder 453 may include a first hook 4533 and a second hook 4535, which may each be detachably inserted into hook receiving regions 398 provided at the second door 39, as shown in FIG. 25. The first hook 4533 and the second hook 4535 may protrude from the second holder body 4531 toward the through-holes 4513 and have bent distal ends. The through-holes 4513 perforated in the receptacle body 4511 may be configured not only to provide a space for movement of the first hook 4533 and the second hook 4535, but also to guide movement of the first hook 4533 and the second hook 4535.

A holder pressure piece 456 may include a fixing plate 4561 secured to the cabinet 1 and a pressure protrusion 4563 protruding from the fixing plate 4561 so as to be inserted into the holder protrusion penetrating hole 382 of the first door 38. When the first door 38 is rotated to close the input opening 11, the pressure protrusion 4563 may apply pressure to the holder protrusion 4537 inserted through the holder protrusion penetrating hole 382. To facilitate coupling between the holder protrusion 4537 and the pressure protrusion 4563, at least one of the pressure protrusion 4563 and/or the holder protrusion 4537 may have an inclined surface.

The second holder support piece 455 may be, for example, a spring, one end of which may be secured to the second holder body 4531 and the other end of which may be secured to the guide rib 4515.

Hereinafter, an operating procedure of the above described second door holder 45 will be described with reference to FIG. 25.

When the first door 38 is positioned against the cabinet 1 to close the input opening 11, the holder protrusion 4537 provided at the second holder 453 is received in the holder protrusion penetrating hole 382 of the first door 38, thereby being supported by the pressure protrusion 4563 of the holder pressure piece 456. Since the first hook 4533 and the second hook 4535 are respectively received in the hook receiving regions 398 of the second door 39, the second door 39 is secured to the first door 38.

If the first door 38 is rotated away from the cabinet 1 in response to an external force, for example, in a clockwise direction for ease of discussion, the second door holder 453 provided at the first door 38 is also rotated clockwise, causing the holder protrusion 4537 to be separated from the pressure protrusion 4563. Once the holder protrusion 4573 has been separated from the pressure protrusion 4563, the second holder body 4531 is moved downward by the second holder support piece 455. As the second holder support piece 455 is moved downward, the first hook 4533 and the second hook 4535 are firmly coupled to the hook receiving regions 398 of the second door 39, thus preventing rotation of the second door 39 during rotation of the first door 38.

Meanwhile, when the first door 38 is in a closed position with respect to the input opening 11, the holder protrusion 4537 is moved upward of the first door 38 by the pressure protrusion 4563, and thus the first hook 4533 and the second hook 4535 are moved so as to be separated from the hook receiving regions 398.

In certain embodiments, it is preferable that the first hook 4533 and the second hook 4535 not be completely separated from the hook receiving regions 398 of the second door 39, even when the first door 38 is fully closed against the input opening 11 of the cabinet 1. This may prevent the second door 39 from being unintentionally rotated, and unintentionally moved away from the cabinet 1 to unintentionally open the input opening, in a state in which no external force is applied.

To allow the first hook 4533 and the second hook 4535 to be easily separated from the hook receiving regions 398 when external force is applied to the second door 39, the first hook 4533 and the second hook 4535 may include an inclined surface.

Figure 26:
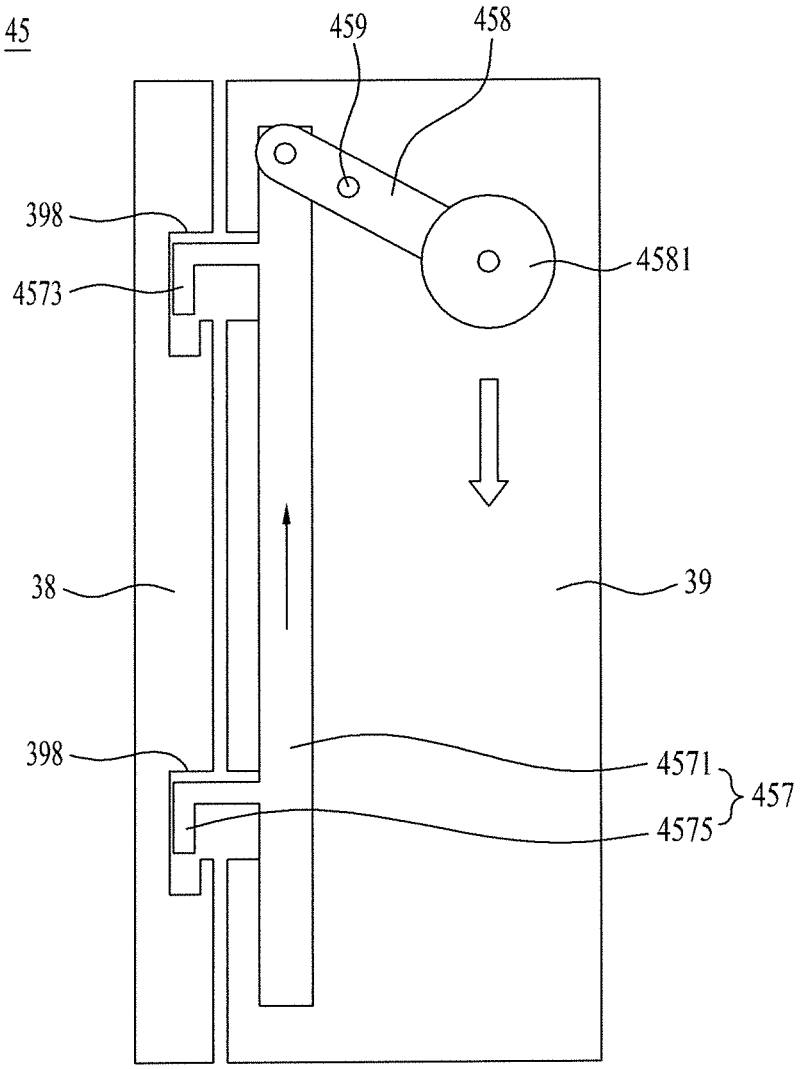

FIG. 26 illustrates another embodiment of the second door holder 45, which includes a weight 4581 that couples the second door 39 and the first door 38.

The second door holder 45 according to this embodiment may include a second holder 457 located in the second door 39, a link 458 having one end coupled to the second holder 457 and the other end secured to the weight 4581, and a rotating shaft 459 to rotatably support the link 458. The second holder 457 may include a second holder body 4571 configured to reciprocate in the second door 39, and a first hook 4573 and a second hook 4575 provided at the second holder body 4571 so as to be detachably inserted into the hook receiving regions 398 of the first door 38.

When the first door 38 is rotated, the second door 39 secured to the first door 38 is also rotated in a corresponding direction and the weight 4581 located in the second door 39 is rotated in the corresponding direction about the rotating shaft 459. As the weight 4581 is rotated in the corresponding direction, the second holder 457 is moved downward of the second door 39, and the first hook 4573 and the second hook 4575 are inserted into the hook receiving regions 398 of the first door 38. In this way, separation of the second door 39 from the first door 38 during rotation of the first door 38 may be prevented.

Hereinafter, a configuration of the first door holder 47 that prevents separation of the first door 38 from the cabinet 1 during rotation of the second door 39 will be described.

As illustrated in FIG. 27, the first door holder 47 may include a first holder receptacle 471 secured to the cabinet 1, a first holder 473 configured to reciprocate in the first holder receptacle 471 so as to secure the first door 38 to the cabinet 1, a first holder support piece 475 located in the first holder receptacle 475 so as to elastically support the first holder 473, and a pressure piece 476 provided at the second door 39 so as to apply pressure to the first holder 473.

The first door 38 may include a hook receiving space 3811 configured to receive the hook 4733 of the first holder 473, and a pressure piece penetrating hole 3813 and a hook penetrating hole 3831 to communicate the hook receiving space 3811 with the outside of the first door 38. The hook receiving space 3811 may be located in the first door frame 381 of the first door 38, the pressure piece penetrating hole 3813 may be perforated in the first door frame 381, and the hook penetrating hole 3831 may be perforated in the first door cover 383 of the first door 38.

The first holder receptacle 471 may include a holder receptacle body 4713 secured to the cabinet 1, a receiving space 4711 defined in the holder receptacle body 4713, and a receptacle through-hole 4712 to communicate the receiving space 4711 with the outside of the holder receptacle body 4713. The receptacle through-hole 4712 may be located to correspond to the hook penetrating hole 3831 perforated in the first door cover 383.

In certain embodiments, the holder receptacle body 4713 may be fixed in the cabinet 1 so as not to be exposed to the outside. In alternative embodiments, the holder receptacle body 4713 may be secured to the surface of the cabinet 1 so as to be exposed to the outside.

In the case in which the holder receptacle body 4713 is fixed in the cabinet 1, the cabinet 1 may have a first holder penetrating hole 15 formed therein to communicate the receptacle through-hole 4712 with the hook penetrating hole 3831.

The first holder 473 may include a first holder body 4731 located in the receiving space 4711 of the first holder receptacle 471, and a hook 4733 provided at the first holder body 4731. The hook 4733 may be exposed to the outside of the first holder receptacle 471 through the receptacle through-hole 4712 and may be located in the hook receiving space 3811 by passing through the first holder penetrating hole 15 and the hook penetrating hole 3831.

In this case, the first holder support piece 475 may be located in the receiving space 4711, thereby elastically supporting the first holder body 4731.

The pressure piece 476 may be provided at the second door 39 so as to protrude toward the first door 38. In the case in which the second door 39 closes the input opening 11 (i.e. the second door 39 is secured to the first door 38), the pressure piece 476 is located in the hook receiving space 3811 by passing through the pressure piece penetrating hole 3813. When the pressure piece 476 is inserted into the hook receiving space 3811, the pressure piece 476 applies pressure to the hook 4733 of the first holder 473, causing the first holder 473 to be moved so as to be separated from the first door 38.

To facilitate coupling between the pressure piece 476 and the hook 4733, at least one of the pressure piece 476 and/or the hook 4733 may have an inclined surface.

In certain circumstances, the hook 4733 be not completely separated from the hook receiving space 3811 even if the pressure piece 476 and the hook 4733 are coupled to each other to allow the first holder 473 to be moved upward of the cabinet 1. To this end, the first door cover 383 may also include a bent portion 3833 that is bent from the hook penetrating hole 3831 toward the hook receiving space 3811 such that the bent portion 3833 continuously contacts the hook 4733 even if the hook 4733 is moved by the pressure piece 476.

However, if the bent portion 3833 and the hook 4733 firmly come into contact with each other, the bent portion 3833 may have difficulty in rotating the first door 38. Thus, the hook 4733 may have an inclined surface to allow the hook 4733 to be easily separated from the bent portion 3833 when the first door 38 is rotated.

Accordingly, if the second door 39 is rotated in response to an external force, the pressure piece 476 provided at the second door 39 is removed from the hook receiving space 3811, thereby causing the hook 4733 to be separated from the pressure piece 476. Once the hook 4733 has been separated from the pressure piece 476, the first holder body 4731 is moved downward of the receiving space 4711 by the first holder support piece 475, such as, for example, a spring or the like.

As the first holder body 4731 is moved downward of the receiving space 4711, the hook 4733 is moved downward of the hook receiving space 3811, thereby being firmly coupled with the bent portion 3833 and preventing the first door 38 from being separated from the cabinet 1 during rotation of the second door 39.

Figure 28:
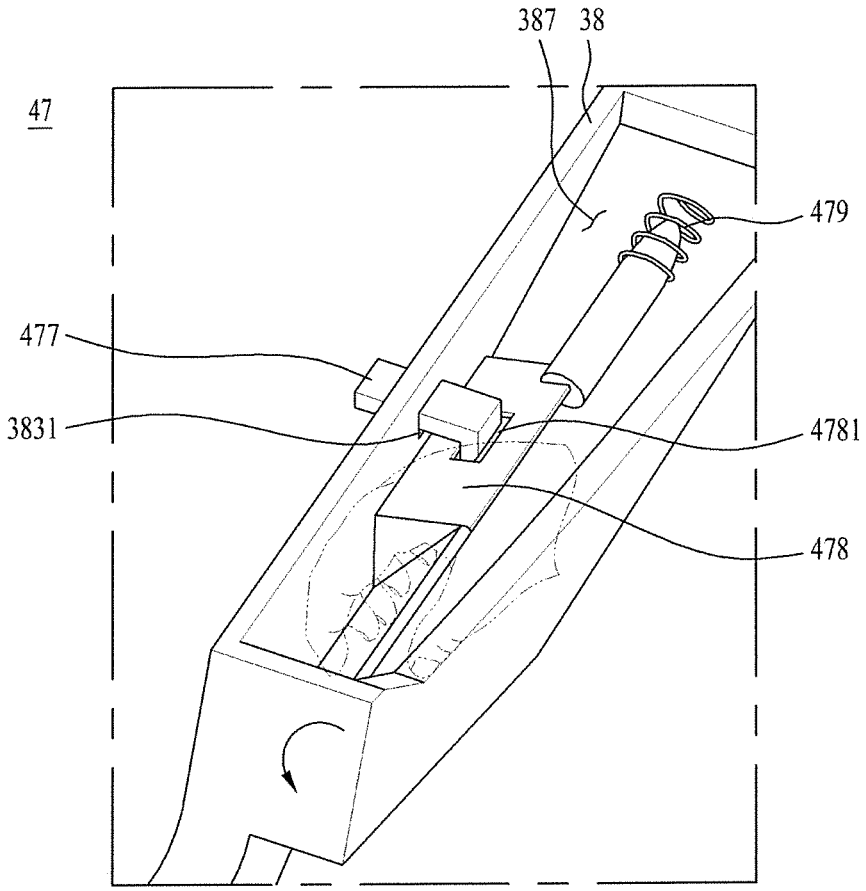

FIG. 28 illustrates another embodiment of the first door holder 47, including a hook 477 provided at the cabinet 1, a locking member 478 rotatably provided in the first door handle 387 such that the hook 477 is detachably coupled to the locking member 478, and an elastic locking member support piece 479 to elastically support the locking member 478 during rotation of the locking member 478. The first door 38 may include a hook penetrating hole 3831 for penetration of the hook 477, and the locking member 478 may include a hook receiving hole 4781 configured to receive the hook 477.

Accordingly, in a state in which the first door 38 is positioned against the cabinet 1 to close the input opening 11, the above described first door holder 47 may prevent the first door 38 from being separated from the cabinet 1 even if the user rotates the second door 39 rotatably secured to the first door 38.

If pressure is applied to the locking member 478 so as to rotate the locking member 478 in the first door handle 387, the hook 477 may be separated from the hook receiving hole 4781, which allows for rotation of the first door 38.

A laundry treatment apparatus is provided that provides for easy input and removal of laundry.

A laundry treatment apparatus is provided in which a door may adjust an opening degree of an input opening to guide input of laundry into a storage space.

A laundry treatment apparatus is provided having a door which may function as a shelf to support laundry when the laundry is removed from a storage space.

A laundry treatment apparatus is provided having at least two doors which have different rotating directions.

A laundry treatment apparatus is provided having at least two doors which have different maximum rotating angles.

A laundry treatment apparatus is provided having a single door, a rotating direction of which is changeable and also, a rotating angle of which is adjustable.

A laundry treatment apparatus as embodied and broadly described herein may include a cabinet defining an external appearance of the laundry treatment apparatus, the cabinet having an input opening, through which laundry is input, a storage placed within the cabinet and configured to store the laundry input into the input opening, and at least two doors to open or close the input opening.

A laundry treatment apparatus as embodied and broadly described herein may include a cabinet defining an external appearance of the laundry treatment apparatus, the cabinet having an input opening, through which laundry is input, a storage placed within the cabinet and configured to store the laundry input into the input opening, a first door having a first door through-hole corresponding to the input opening, the first door being rotatably secured to the cabinet, a second door rotatably secured to the first door so as to open or close the first door through-hole, and a locking unit including a second door holder to secure the second door to the first door during rotation of the first door.

A laundry treatment apparatus as embodied and broadly described herein may include a cabinet defining an external appearance of the laundry treatment apparatus, the cabinet having an input opening, through which laundry is input, a storage placed within the cabinet and configured to store the laundry input into the input opening, a first door having a first door through-hole communicating with the input opening, the first door being rotatably secured to the cabinet, a second door rotatably secured to the first door so as to open or close the first door through-hole, and an angle adjusting unit to adjust a rotating angle of the first door.

A laundry treatment apparatus as embodied and broadly described herein may include a cabinet defining an external appearance of the laundry treatment apparatus, the cabinet having an input opening, through which laundry is input, a storage placed within the cabinet and configured to store the laundry input into the input opening, a first door rotatably secured to the cabinet so as to open or close the input opening, and an angle adjusting unit to adjust a rotating angle of the first door.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treatment apparatus, comprising:

a cabinet having an opening formed therein;

a receiving space provided within the cabinet and configured to receive laundry through the opening formed in the cabinet;

a first door rotatably coupled to the cabinet, the first door having a first door through-hole corresponding to the opening formed in the cabinet;

a second door rotatably coupled to the first door so as to selectively open and close the first door through-hole; and a locking mechanism including a first door holder that secures the first door to the cabinet during rotation of the second door to open the first door through-hole, wherein the first holder includes:

a first holder reciprocally coupled to the cabinet, wherein the first holder detachably couples the first door to the cabinet; and a pressure piece provided at the second door, wherein the pressure piece moves the first holder in a direction to be separated from the first door when the second door is rotated in a second direction toward a closed position relative to the opening in the cabinet.

2. The apparatus of claim 1, wherein at least one of a rotating direction or a maximum rotating angle of the first and second doors is different.

3. The apparatus of claim 1, wherein the locking mechanism further includes a second door holder that secures the second door to the first door during rotation of the first door, wherein the second door holder is coupled to the second door when the first door is rotated in a first direction toward an open position relative to the opening in the cabinet, and is moved in a direction to be separated from the second door when the first door is rotated in a second direction toward a closed position relative to the opening in the cabinet.

4. The apparatus of claim 3, wherein the second door includes at least one hook receiving region provided at a surface thereof that comes into contact with the first door, and wherein the second door holder includes:

a second holder having a second holder body configured to be reciprocally movable between the first door and the second door, at least one hook provided at the second holder body so as to be detachably coupled to the at least one hook receiving region, and a holder protrusion provided at the second holder body so as to protrude toward the cabinet by penetrating the first door; and a pressure piece provided at the cabinet to apply pressure to the holder protrusion such that the at least one hook is moved in a direction to be separated from the at least one hook receiving region when the first door closes the input opening.

5. The apparatus of claim 4, wherein the second door holder further includes:

a second holder receptacle provided between the first door and the second door to guide reciprocating movement of the second holder; and a second holder support piece having one end secured to the second holder and the other end secured to the second holder receptacle, the second holder support piece serving to elastically support the second holder.

6. The apparatus of claim 5, wherein the second holder receptacle includes:

a receptacle body located between the first door and the second door;

a guide rib provided at the receptacle body to define a receiving space for receiving the second holder; and a through-hole perforated in the receptacle body for penetration of the hook.

7. The apparatus of claim 1, wherein the first door further includes a hook receiving space defined in the first door, a hook penetrating hole located to face the cabinet, the hook penetrating hole communicating the hook receiving space with the outside, and a pressure piece penetrating hole located to face the second door, the pressure piece penetrating hole communicating the hook receiving space with the outside, wherein the first door holder further includes a first holder receptacle secured to the cabinet so as to guide reciprocating movement of the first holder, wherein the first holder includes a first holder body provided in the first holder receptacle in a reciprocally movable manner and a hook provided at the first holder body, the hook being configured to be inserted into the hook receiving space through the hook penetrating hole, and wherein the pressure piece is provided at the second door and serves to move the hook in a direction to be separated from the hook penetrating hole when inserted into the hook receiving space through the pressure piece penetrating hole.

8. The apparatus of claim 7, further comprising a first holder support piece provided at the first holder receptacle and serving to elastically support the first holder.

9. The apparatus of claim 3, further comprising a second door hinge provided at a position corresponding to the second door holder with the first door through-hole interposed therebetween, the second door hinge forming a rotating shaft of the second door, wherein positions of the second door holder and the second door hinge are changeable to each other.

10. A laundry treatment apparatus, comprising:

a cabinet having an opening formed therein;

a receiving space provided within the cabinet that receives laundry through the opening formed in the cabinet;

a first door rotatably coupled to the cabinet, the first door having a first door through-hole corresponding to the opening formed in the cabinet; and a second door rotatably coupled to the first door so as to selectively open and close the first door through-hole, wherein the first door includes first and second surfaces opposite to each other, the first surface having a first opening and the second surface having a second opening, the first and second openings being offset from each other in a first direction, and wherein the cabinet includes a hook having a first end elastically biased in the first direction and a second end configured to be inserted into the first opening, and the second door includes a strike configured to be inserted into the second opening.

11. The apparatus of claim 10, wherein when the second door is closed, the strike is inserted into the second opening and the hook is biased upward to allow the first door to open.

12. The apparatus of claim 10, wherein when the second door is open, the strike is removed from the second opening and the hook is biased downward to fixedly couple the first door to the cabinet.

13. The apparatus of claim 10, wherein the second door includes first and second surfaces opposite to each other, the first surface having at least one opening, wherein the first door includes at least one hook elastically biased in the first direction including a first end configured to be inserted into the at least one opening, and a second end configured to contact a protrusion tab that protrudes from a front surface of the cabinet.

14. The apparatus of claim 13, wherein when the first door is closed, the at least one hook is biased upward by the second end contacting the protrusion tab to allow the second door to open.

15. The apparatus of claim 13, wherein when the first door is open, the at least one hook is biased downward to fixedly couple the second door to the first door.

* * * * *